US012369765B2

(12) United States Patent
Kim et al.

(10) Patent No.: US 12,369,765 B2
(45) Date of Patent: Jul. 29, 2025

(54) ROBOT CLEANER AND CONTROL METHOD THEREOF

(71) Applicant: SAMSUNG ELECTRONICS CO., LTD., Suwon-si (KR)

(72) Inventors: Elijah Kim, Suwon-si (KR); Hongseok Choi, Suwon-si (KR); Sunghyun Kim, Suwon-si (KR); Juyeong Kim, Suwon-si (KR); Junwon Seo, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 18/200,911

(22) Filed: May 23, 2023

(65) Prior Publication Data

US 2024/0032762 A1 Feb. 1, 2024

Related U.S. Application Data

(63) Continuation of application No. PCT/KR2023/006053, filed on May 3, 2023.

(30) Foreign Application Priority Data

Jul. 28, 2022 (KR) ..... 10-2022-0094110
Sep. 2, 2022 (KR) ..... 10-2022-0111653

(51) Int. Cl.
*A47L 11/40* (2006.01)
*A47L 11/282* (2006.01)

(52) U.S. Cl.
CPC ..... *A47L 11/4038* (2013.01); *A47L 11/282* (2013.01); *A47L 11/4011* (2013.01); *A47L 11/4069* (2013.01); *A47L 2201/06* (2013.01)

(58) Field of Classification Search
CPC ..... A47L 11/282; A47L 11/4038; A47L 11/4069; A47L 2201/00; A47L 2201/02; A47L 2201/06
See application file for complete search history.

(56) References Cited

U.S. PATENT DOCUMENTS 6,871,371 B2 3/2005 Guest
9,717,388 B2 8/2017 Jeong et al.
(Continued)

FOREIGN PATENT DOCUMENTS

CN 111345746 A 6/2020
CN 112244699 A * 1/2021 ..... A47L 11/282
(Continued)

OTHER PUBLICATIONS

International Search Report, PCT/ISA/210, issued on Jul. 26, 2023 in International Patent Application No. PCT/KR2023/006053.
(Continued)

*Primary Examiner* — Randall E Chin
(74) *Attorney, Agent, or Firm* — STAAS & HALSEY LLP

(57) ABSTRACT

A robot cleaner includes a rotation motor; a rotation member that is rotatable by driving of the rotation motor having a first surface, a second surface, and an opening through the rotation member and penetrating the first surface and the second surface; and a floorcloth coupling member disposed on the second surface and having a floorcloth attaching unit insertable into the opening to be detachably coupled to a floorcloth in contact with the first surface. The rotation member and the floorcloth coupling member are configured so that, when the floorcloth attaching unit is inserted into the opening and detachably coupled to the floorcloth, the rotation member rotates in a first state, the floorcloth attaching unit remains coupled to the floorcloth. When the rotation member rotates in a second state, the floorcloth attaching unit exits the opening so that the floorcloth becomes detached from the floorcloth attaching unit.

20 Claims, 18 Drawing Sheets

(56) References Cited

U.S. PATENT DOCUMENTS

| | | | |
|---|---|---|---|
| 11,058,268 | B1 | 7/2021 | Ebrahimi Afrouzi et al. |
| 11,571,103 | B2 | 2/2023 | Zhang et al. |
| 11,918,160 | B2 | 3/2024 | Zhang et al. |
| 2020/0139561 | A1 | 5/2020 | Kim et al. |
| 2021/0196092 | A1 | 7/2021 | Zhang et al. |
| 2022/0079406 | A1 | 3/2022 | Zhang et al. |
| 2022/0167818 | A1 | 6/2022 | Zhang et al. |

FOREIGN PATENT DOCUMENTS

| | | | | | |
|---|---|---|---|---|---|
| CN | 113261890 | A | * | 8/2021 | ..... A47L 11/40 |
| CN | 111557617 | B | | 9/2021 | |
| JP | 2020-99666 | | | 7/2020 | |
| KR | 10-2007-0101432 | | | 10/2007 | |
| KR | 10-1233027 | | | 2/2013 | |
| KR | 10-2014-0096591 | | | 8/2014 | |
| KR | 10-2015-0078093 | | | 7/2015 | |
| KR | 10-2016-0134413 | | | 11/2016 | |
| KR | 10-2020-0052071 | | | 5/2020 | |
| KR | 10-2103420 | | | 5/2020 | |
| KR | 10-2110385 | | | 5/2020 | |
| KR | 112428124 | B | | 3/2022 | |
| KR | 10-2525001 | | | 4/2023 | |

OTHER PUBLICATIONS

Written Opinion, PCT/ISA/237, issued on Jul. 26, 2023 in International Patent Application No. PCT/KR2023/006053.

* cited by examiner (a)

(b)

(c)

ROBOT CLEANER AND CONTROL METHOD THEREOF

CROSS-REFERENCE TO RELATED APPLICATIONS

This application is a continuation application of International Application No. PCT/KR2023/006053 designating the United States, filed on May 3, 2023, in the Korean Intellectual Property Receiving Office, which claims priority from Korean Patent Application No. 10-2022-0094110, filed on Jul. 28, 2022, and Korean Patent Application No. 10-2022-0111653, filed on Sep. 2, 2022, in the Korean Intellectual Property Office, the disclosure of each of which is hereby incorporated by reference herein in its entirety.

BACKGROUND

Field

Embodiments of the disclosure relate to a robot cleaner capable of attaching and detaching a floorcloth and a control method thereof.

Description of Related Art

A robot cleaner is a device for automatically cleaning a certain cleaning space while travelling throughout the cleaning space without any user's manipulation. In general, a robot cleaner can perform the operation of inhaling foreign substances, such as e.g., dust accumulated on a surface (e.g., a floor surface) to be cleaned or wiping foreign substances, such as e.g., dirt attached to the surface to be cleaned with a floorcloth. Amongst such robot cleaners, a type of robot cleaner is used in which the floorcloth (or damp cloth) is attached to its one end and the floorcloth is rotated to wipe out foreign substances attached to the surface to be cleaned.

Typically, as the cleaning progresses, the floorcloth attached to the robot cleaner may get more and more contaminated, and therefore, its user has to replace the contaminated floorcloth attached to the robot cleaner with a new floorcloth so as to continue an effective cleaning.

SUMMARY

According to an embodiment of the present disclosure, a robot cleaner may include a rotation motor. The robot cleaner may include a rotation member that is rotatable by driving of the rotation motor and having a first, a second surface opposite to the first surface, and an opening through the rotation member and penetrating the first surface and the second surface. The robot cleaner may include a floorcloth coupling member disposed on the second surface and having a floorcloth attaching unit insertable into the opening to be detachably coupled to a floorcloth in contact with the first surface. The rotation member and the floorcloth coupling member may be configured to, when the floorcloth attaching unit is inserted into the opening and detachably coupled to the floorcloth in contact with the first surface, and the rotation member rotates in a first state, the floorcloth attaching unit remains coupled to the floorcloth, and when the floorcloth attaching unit is inserted into the opening and detachably coupled to the floorcloth in contact with the first surface, and the rotation member rotates in a second state, the floorcloth attaching unit may exit the opening so that the floorcloth becomes detached from the floorcloth attaching unit.

According to an embodiment of the present disclosure, the rotation member may be configured to rotate in a second direction to detach the floorcloth from the floorcloth attaching unit in the second state. The rotation member may include a first inclined portion which extends ascending from an inner position of the opening toward the second surface along the second direction, at one side of the opening. The floorcloth attaching unit may include a second inclined portion disposed to face the first inclined portion above the first inclined portion, when the floorcloth attaching unit is inserted into the opening. When the rotation member rotates in the second direction in the second state, the second inclined portion of the floorcloth attaching unit may ascend along the first inclined portion of the rotation member to exit the opening.

According to an embodiment of the present disclosure, the rotation member may be configured to rotate in the second direction to detach the floorcloth from the floorcloth attaching unit in the second state and may be configured to rotate in a first direction opposite to the second direction to clean a floor surface in the first state. The rotation member may include a first reverse inclined portion which extends descending from the second surface toward an outside of the opening along the first direction, at one side of the opening. When the floorcloth attaching unit is inserted into the opening, the floorcloth attaching unit may include a second reverse inclined portion disposed to face the first reverse inclined portion underneath the first reverse inclined portion. When the rotation member rotates in the first direction in the first state, the first reverse inclined portion and the second reverse inclined portion may be engaged with each other.

According to an embodiment of the present disclosure, the robot cleaner may include a stopper configured to limit rotation of the floorcloth coupling member, when coupled to the floorcloth coupling member. The floorcloth coupling member may have a stopper coupling capable of coupling with the stopper.

According to an embodiment of the present disclosure, in the first state the stopper may be a state released from the stopper coupling, and in the second state the stopper may be a state that the stopper is coupled to the stopper coupling to limit rotation of the floorcloth coupling member.

According to an embodiment of the present disclosure, the robot cleaner may further include a lifting motor configured to move the rotation member in an axial direction. The second state may occur as the lifting motor drives the rotation member to move toward the stopper to cause the stopper to be coupled to the stopper coupling.

According to an embodiment of the present disclosure, the robot cleaner may further include a stopper moving unit configured to move the stopper toward the stopper coupling or away from the stopper coupling. The second state may occur as the stopper moving unit drives the stopper to move toward the stopper coupling to be coupled to the stopper coupling.

According to an embodiment of this disclosure, the stopper may have an insert that may be inserted into the stopper coupling along a third direction from an upper side of the floorcloth coupling member. The insert may be configured to have at least one inclined surface inclined with respect to the third direction.

According to an embodiment of the present disclosure, the stopper may have an insert that can be inserted into the stopper coupling along the third direction from an upper side of the second surface of the floorcloth coupling member at one end of the insert. The stopper may have an elastic member disposed at an other end of the insert.

According to an embodiment of this disclosure, the rotation motor and the rotation member may be connected via a rotation shaft member, and the rotation shaft member may be disposed to penetrate the floorcloth coupling member.

According to an embodiment of the present disclosure, the robot cleaner may include a rotation member that is rotatable and has a first surface, a second surface opposite to the first surface, and an opening through the rotation member and penetrating the first surface and the second surface. The robot cleaner also includes a floorcloth coupling member disposed on the second surface, and having a floorcloth attaching unit insertable into the opening to be detachably coupled to a floorcloth in contact with the first surface. The robot cleaner also includes a stopper that is coupleable to the floorcloth coupling member and configured to limit rotation of the floorcloth coupling member when coupled to the floorcloth coupling member. The rotation member, the floorcloth coupling member, and the stopper are configured so that (a) when the floorcloth attaching unit is inserted into the opening and detachably coupled to the floorcloth in contact with the first surface, and the rotation member rotates in a first state in which the stopper is uncoupled from the floorcloth coupling member, the floorcloth attaching unit remains coupled to the floorcloth, and (b) when the floorcloth attaching unit is inserted into the opening and detachably coupled to the floorcloth in contact with the first surface, and the rotation member rotates in a second state in which the sopper is coupled to the floorcloth coupling member, the floorcloth attaching unit exits the opening so that the floorcloth becomes detached from the floorcloth attaching unit.

A control method of the robot cleaner may include, with the floorcloth attaching unit inserted into the opening and detachably coupled to the floorcloth in contact with the first surface, determining whether replacement of the floorcloth is required. Based on determining that the replacement of the floorcloth is required, the method may include coupling the stopper to the floorcloth coupling member. The method may include, with the floorcloth attaching unit inserted into the opening and detachably coupled to the floorcloth in contact with the first surface and the stopper coupled to the floorcloth coupling member, rotating the rotation member in the second state so that the floorcloth attaching unit exits the opening and the floorcloth becomes detached from the floorcloth attaching unit.

According to an embodiment of the present disclosure, the robot cleaner may include a lifting motor configured to move the rotation member along an axial direction and the method may include the coupling the stopper to the floorcloth coupling member includes moving the rotation member toward the stopper by driving the lifting motor.

According to an embodiment of the present disclosure, the robot cleaner may further include a stopper moving unit configured to move the stopper in a direction toward the floorcloth coupling member or away from the floorcloth coupling member. The coupling the stopper to the floorcloth coupling member may include moving the stopper toward the stopper coupling by means of the stopper moving unit.

According to an embodiment of the present disclosure, the method may include rotating the rotation member in the second state and then determining whether a new floorcloth is required to be attached to the floorcloth attaching unit. The method may include rotating the rotation member in an opposite direction to a rotation direction in which the rotation member was rotated to detach the floorcloth from the floorcloth attaching unit, in a state that the stopper is coupled to the floorcloth coupling member, when it is determined that a new floorcloth is required to be attached to the floorcloth attaching unit. The method may further include uncoupling the stopper from the floorcloth coupling member.

According to an embodiment of the present disclosure, the method may include determining whether to perform floor cleaning. Based on determining that the floor cleaning is to be performed, the method may further include rotating the rotation member in the first state in which the stopper is uncoupled from the floorcloth coupling member and the floorcloth attaching unit is inserted into the opening and detachably coupled to the floorcloth in contact with the first surface.

According to an embodiment of the present disclosure, the robot cleaner can automatically replace the floorcloth for itself without a need for the user to replace the floorcloth, thereby improving the use's convenience. According to an embodiment of the present disclosure, the robot cleaner can operate to detach a currently mounted floorcloth at a user-designated location, such as near a bathroom or a laundry room, and then enter a docking station to mount a new floorcloth in place of the used one, thereby improving the user's convenience. According to an embodiment of the present disclosure, the robot cleaner can enter the docking station to automatically replace the floorcloth on its own at the docking station, thereby enabling to further enhance the user's convenience.

BRIEF DESCRIPTION OF THE DRAWINGS

The above and other aspects, features, and advantages of certain embodiments of the disclosure will be more apparent from the following description taken in conjunction with the accompanying drawings, in which.

DETAILED DESCRIPTION

Figure 1:
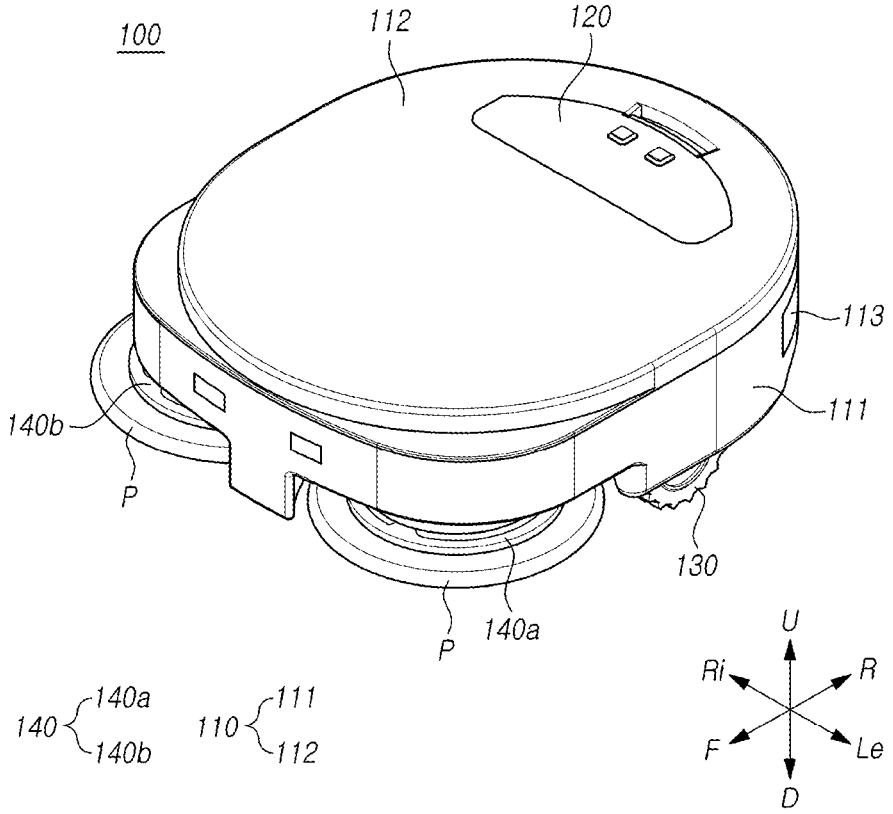
FIG. 1 is a perspective view of a robot cleaner according to an embodiment of the disclosure.

Hereinafter, various embodiments of the present disclosure will be described with reference to the drawings in such a detailed manner that those having ordinary knowledge in the technical field to which the disclosure pertains can easily implement the disclosed invention. However, the disclosure may be implemented in several different forms and is not limited to the embodiments described herein. In conjunction with the description of the drawings, like or similar reference numerals may be used for such like or similar components throughout the specification and the drawings. Further, in the drawings and their related descriptions, descriptions of well-known functions and configurations may be omitted for clarity and conciseness.

Various embodiments of the present disclosure may have a detachable structure for mounting or detaching a floorcloth used for cleaning, thereby providing a robot cleaner capable of performing automatic replacement of the floorcloth without user's intervention.

The technical problems to be achieved in the present disclosure are not limited to those described above, and other technical challenges not mentioned herein may be derived from the exemplary embodiments of the present disclosure by a person skilled in the art.

The effects that can be obtained from the exemplary embodiments of the present disclosure may be clearly derived and understood by those having ordinary knowledge in the technical field to which the embodiments of the disclosure belong, from the following description. That is to say, any unintended effects according to carrying out the exemplary embodiments of the disclosure may be clearly derived by those having ordinary knowledge in the art, from the exemplary embodiments of the disclosure.

Figure 2:
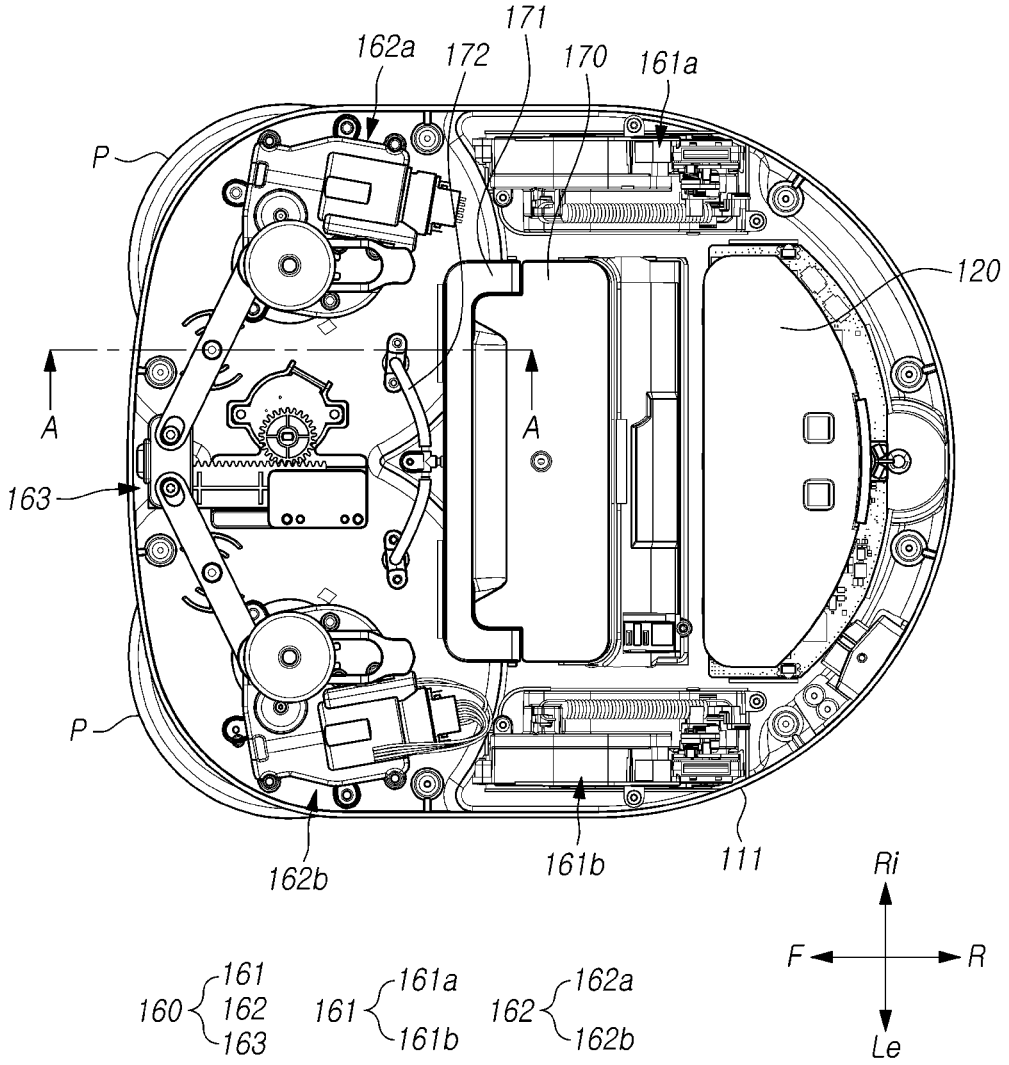
FIG. 2 is a view for explaining an internal configuration of a main body of a robot cleaner according to an embodiment of the disclosure.
Figure 3:
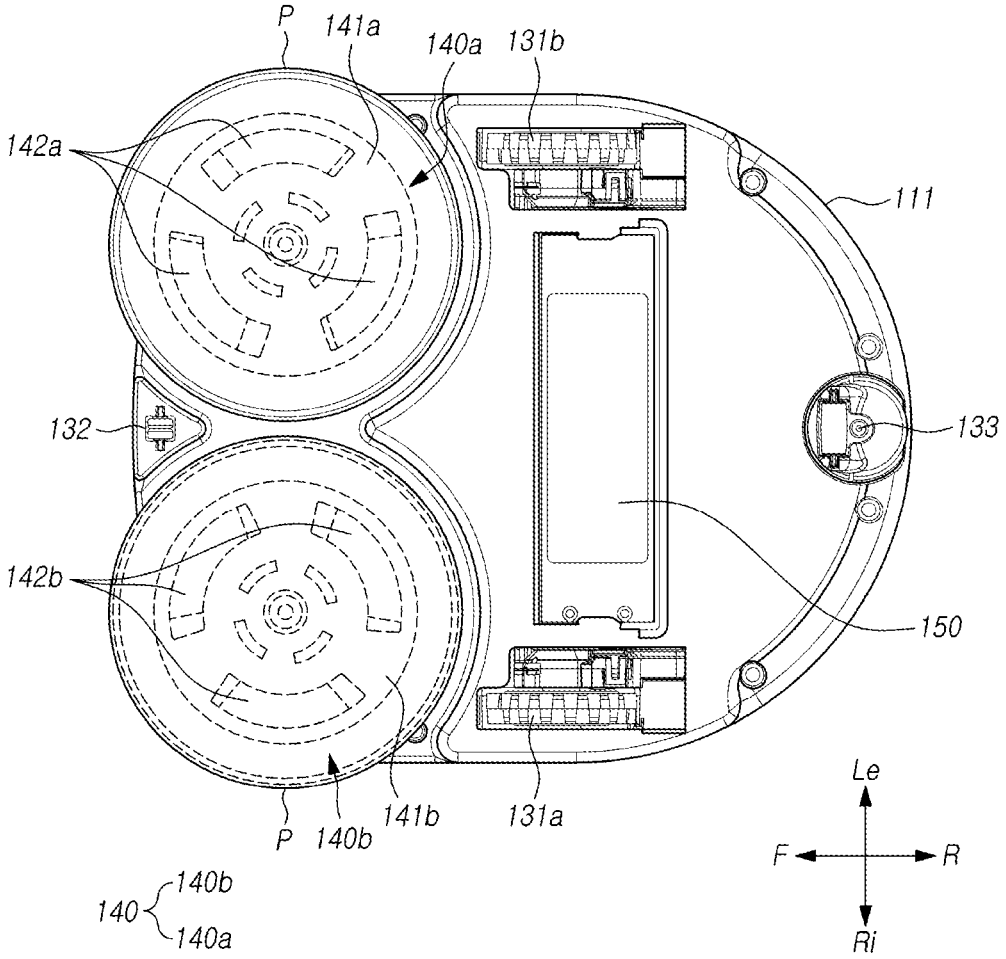
FIG. 3 is a bottom view of a robot cleaner according to an embodiment of the disclosure.

FIG. 1 is a perspective view of a robot cleaner according to an embodiment of the disclosure. FIG. 2 is a view for explaining an internal configuration of a main body of a robot cleaner according to an embodiment of the disclosure. FIG. 3 is a bottom view of a robot cleaner according to an embodiment of the disclosure.

Referring to FIGS. 1 to 3, in an embodiment, a robot cleaner 100 may in a state that a floorcloth (P) (e.g., a damp floorcloth or a dry floorcloth) capable of being in contact with a surface to be cleaned (e.g., a floor surface) is mounted in a floorcloth unit 140 positioned in a lower part. The robot cleaner 100 can perform cleaning (or wiping with a floorcloth) to remove foreign substances attached onto the surface to be cleaned using the floorcloth (P) mounted onto the floorcloth unit 140. The robot cleaner 100 may rotate, for example, the floorcloth (P) in use and remove foreign substances attached onto the floor surface, using a friction force between the floorcloth (P) and the floor surface generated by rotation of the floorcloth (P). The robot cleaner 100 may replace the contaminated floorcloth (P) mounted onto the floorcloth unit 140 for itself. Hereinafter, the attaching/detaching operation and structure of the floorcloth (P) of the robot cleaner 100 will be described later.

According to an embodiment, the robot cleaner 100 may include a main body 110, a control panel 120, a travelling unit 130, a floorcloth unit 140, a battery 150, a driving unit 160, and a liquid container 170.

According to an embodiment, the main body 110 may form a substantial appearance of the robot cleaner 100. In an embodiment, the main body 110 may include a cleaner body 111 and a cleaner cover 112. In an embodiment, while the robot cleaner 100 is driven for cleaning, the cleaner body 111 may form the appearance of a lower part disposed adjacent to the floor surface (or a surface to be cleaned) and a side part extending upward from corners of the lower part to form a side of the robot cleaner 100. Although not specifically illustrated, according to an embodiment, the robot cleaner 100 may include a bumper capable of mitigating any external impact onto the side of the cleaner body 111.

According to an embodiment, a power button 113 may be disposed on one side of the cleaner body 111. In an embodiment, the power button 113 may be turned on/off by a user to turn on/off the power of the robot cleaner 100. The power button 113 may be implemented by, for example, a button switch, but the disclosure is not limited thereto.

According to an embodiment, the cleaner body 111 may be formed to open its uppermost side. In an embodiment, an inner space in which various components (e.g., driving unit 160 or liquid container 170) for operating the robot cleaner 100 are disposed may be formed inside the cleaner body 111.

According to an embodiment, the cleaner cover 112 may form an upper appearance of the robot cleaner 100. In an embodiment, the cleaner cover 112 may be coupled to an uppermost side of the cleaner body 111. In an embodiment, the cleaner cover 112 may be provided to cover an opening of the cleaner body 111. In an embodiment, the cleaner cover 112 may be detachably coupled to the cleaner body 111. After removing the cleaner cover 112, the user may access the components inside the main body 110 through the opening in the upper part of the cleaner body 111. According to an embodiment, the cleaner body 111 and the cleaner cover 112 may be integrally formed.

According to an embodiment, the control panel 120 may be disposed in an upper part of the robot cleaner 100. The control panel 120 may be disposed on the upper surface of the cleaner cover 112, for example.

According to an embodiment, the control panel 120 may receive various instructions/commands related to the operation of the robot cleaner 100 from a user. In an embodiment, the control panel 120 may include an input device such as e.g., a button, a switch, or a touch panel. In this context, the robot cleaner 100 may receive a command (e.g., start/stop cleaning, or change cleaning mode) related to the various operation of the robot cleaner 100 from the user via the control panel 120. In an embodiment, the control panel 120 may include a signal input device for receiving various commands input from the user in the form of an infrared signal via an external remote controller, and the disclosure is not limited to any specific form.

According to an embodiment, the control panel 120 may provide a current state related to the operation of the robot cleaner 100 to the user. In an embodiment, the control panel 120 may include a display device such as a display. In this connection, the robot cleaner 100 may visually transmit information (e.g., a current cleaning mode or a battery state) about the current state of the robot cleaner 100 to the user via the display device. In an embodiment, the control panel 120 may be integrally provided with the input device or the display device, but the disclosure is not limited thereto.

According to an embodiment, the travelling unit 130 may be disposed on a bottom surface of the cleaner body 111. In an embodiment, the travelling unit 130 may be configured to enable free movement of the robot cleaner 100. The robot cleaner 100 may freely travel throughout a cleaning space, using the travelling unit 130.

According to an embodiment, the travelling unit 130 may include one or more wheels connected to the driving unit 160 to receive power for rotation. The travelling unit 130 may include, for example, a pair of main wheels (e.g., a first main wheel 131*a* and a second main wheel 131*b*). In an embodiment, the first main wheel 131*a* and the second main wheel 131*b* may be disposed to maintain a balance of the robot cleaner 100. The first main wheel 131*a* and the second main wheel 131*b* may be disposed at both edges of the bottom surface of the cleaner body 111, for example.

According to an embodiment, the travelling unit 130 may include a first sub-wheel 132 or a second sub-wheel 133. In an embodiment, the first sub-wheel 132 and the second sub-wheel 133 may be respectively disposed at a front side (e.g., F direction) and a rear side (e.g., R direction) in a direction orthogonal to a direction in which the first main wheel 131*a* and the second main wheel 131*b* are disposed.

The travelling direction of the robot cleaner 100 may be determined according to how the movement of each of the first main wheel 131*a* and the second main wheel 131*b* are controlled. The robot cleaner 100 may move forward (e.g., in F direction) or backward (e.g., in R direction), when the first main wheel 131*a* and the second main wheel 131*b* are controlled in the same direction and speed. For example, when the first main wheel 131*a* and the second main wheel 131*b* are controlled in different directions and/or speeds, the robot cleaner 100 may travel changing the direction of movement corresponding to a preset direction.

In an embodiment, each of the first sub-wheel 132 and the second sub-wheel 133 may be arranged so that the robot cleaner 100 is kept well-balanced when the robot cleaner 100 moves forward (e.g., in the F direction) or backward (e.g., in the R direction). The first sub-wheel 132 may be disposed in a front side (e.g., in the F direction) of the bottom surface of the cleaner body 111. The second sub-wheel 133 may be disposed at a rear side (e.g., in the R direction) of the bottom surface of the cleaner body 111.

According to an embodiment, the floorcloth unit 140 may be disposed in the lowermost part of the robot cleaner 100. The floorcloth unit 140 may be disposed on the bottom surface of the cleaner body 111, for example. In an embodiment, the floorcloth unit 140 may be disposed in front side of the bottom surface (e.g., in the F direction) of the cleaner body 111, but the disclosure is not limited thereto. The floorcloth (P) (e.g., a damp floorcloth or a dry floorcloth) for wiping the surface to be cleaned, such as a floor surface, may be detachably coupled to the floorcloth unit 140.

In an embodiment, the floorcloth unit 140 may rotate clockwise or counterclockwise together with the floorcloth (P) mounted onto the floorcloth unit 140. When the floorcloth unit 140 rotates together with the floorcloth (P) coupled thereto, friction may occur between the floorcloth (P) and the floor surface, with which the robot cleaner 100 can remove foreign substances attached onto the floor surface.

In an embodiment, the floorcloth unit 140 may ascend or descend within a predetermined range in a height direction (or a direction perpendicular to the ground) of the robot cleaner 100 (e.g., U or D direction of FIG. 1).

In an embodiment, the floorcloth unit 140 may include a first floorcloth unit 140*a* or a second floorcloth unit 140*b*. The first floorcloth unit 140*a* and the second floorcloth unit 140*b* may be configured to correspond to each other in terms of their operation, structure, and shape.

In an embodiment, the floorcloth unit 140 (e.g., the first floorcloth unit 140*a* and the second floorcloth unit 140*b*) may include a rotation member (e.g., a first rotation member 141*a* or a second rotation member 141*b*), and a floorcloth coupling member (e.g., a first floorcloth coupling member 142*a* and a second floorcloth coupling member 142*b*), respectively. In FIG. 3, the rotation members (141*a* and 141*b*) and the floorcloth coupling members (142*a* and 142*b*) are shown to be covered by the floorcloth (P) coupled to the respective floorcloth unit 140, and for better illustration of this arrangement, each of the rotation members (141*a* and 141*b*) and the floorcloth coupling members (142*a* and 142*b*) is illustrated in a dotted line.

In an embodiment, the first and second rotation members 141*a* and 141*b* may have a disk shape as a whole, but the present disclosure is not limited thereto. According to an embodiment, a diameter of the first rotation member 141*a* may be set to be substantially the same as or smaller than a diameter of the floorcloth (P), but the present disclosure is not limited thereto. Likewise, a diameter of the second rotation member 141*b* may be set to be substantially the same as or smaller than a diameter of the floorcloth (P), but the present disclosure is not limited thereto.

In an embodiment, one or more attachment members (e.g., an attachment member 1424 of FIG. 6B) to be described later may be disposed in each of the first and second floorcloth coupling members 142*a* and 142*b*. According to an embodiment, each of the attachment members 1424 disposed in each of the first and second floorcloth coupling members 142*a* and 142*b* may come into contact with and be coupled to the floorcloth (P) disposed underneath the first and second rotation members 141*a* and 141*b* through an opening (e.g., an opening 1411 of FIG. 6A) provided in the first and second rotation members 141*a* and 141*b*. Hereinafter, a detailed structure of the floorcloth unit 140 will be described in more detail with reference to FIG. 4 and its subsequent drawings.

According to an embodiment, a battery 150 may be disposed in a lower part of the robot cleaner 100. In an embodiment, the battery 150 may be provided in a bottom surface of the cleaner body 111 to be detachable from the lower side, but the present disclosure is not limited thereto. The battery 150 is electrically connected to the driving unit 160 and may supply electric power to the driving unit 160. The battery 150 may be a rechargeable type of secondary battery, but the disclosure is not limited thereto.

According to an embodiment, the driving unit 160 may be provided inside the main body 110 of the robot cleaner 100. The driving unit 160 may be, for example, disposed in an inner accommodation space formed by the cleaner body 111. The driving unit 160 may include, for example, a motor and/or an actuator, and may have a plurality of components for supplying power to each of the travelling unit 130 or the floorcloth unit 140. In an embodiment, the driving unit 160 may include a travelling driver 161, a rotation driver 162, or an up/down driver 163.

In an embodiment, the travelling driver 161 may include a pair of travelling drivers 161*a* and 161*b*. Although not specifically illustrated, in an embodiment, each of the pair of travelling drivers 161*a* and 161*b* may include a configuration of a motor and an actuator, and may be connected to each of the travelling units 130, for example, the first and second main wheels 131*a* and 131*b*, to provide power required to move the robot cleaner 100.

In an embodiment, the rotation driver 162 may include a pair of rotation drivers 162*a* and 162*b*. Although not explicitly illustrated, in an embodiment, each of the pair of rotation drivers 162*a* and 162*b* may include a configuration of a rotation motor and an actuator, and may be connected to each of the floorcloth units 140*a* and 140*b* to provide power required to rotate the rotation members 141*a* and 141*b* of each floorcloth unit.

In an embodiment, the up/down driver 163 may be connected to the floorcloth unit 140 to provide power required to ascend and/or descend the floorcloth unit 140 in a height direction (or a direction perpendicular to the ground). Although not explicitly shown, the up/down driver 163 may include a lifting motor and an actuator.

According to an embodiment, the liquid container 170 may store, for example, liquid for wet cleaning. The liquid stored in the liquid container 170 may be, for example, water, but the liquid is not limited thereto and may be a liquid material such as e.g., soap or solvent used for cleaning. The liquid container 170 may be detachably disposed in an accommodation space inside the cleaner body 111. The user may access the liquid container 170 by separating the cleaner cover 112 from the cleaner body 111 to open the upper part of the cleaner body 111. According to an embodiment, the liquid container 170 may include a gripper 171. The gripper 171 may be provide, for example, to allow the user to grip the liquid container 170 when separating and transporting the liquid container 170.

According to an embodiment, the robot cleaner 100 may include a liquid dispenser 172. The liquid dispenser 172 may have one end fluidly communicating with the liquid container 170 and the other end fluidly communicating with the floorcloth unit 140 disposed in a lowermost part of the robot cleaner 100. The liquid dispenser 172 may be, for example, a tube or a hose. The robot cleaner 100 may supply liquid (e.g., water) to the floorcloth (P) mounted on the floorcloth unit 140 through the liquid container 170 and/or the liquid dispenser 172.

Although not shown in FIGS. 1 to 3, the robot cleaner 100 may include a controller (e.g., a controller 180 of FIG. 4) that generates commands for controlling the operation of each part of the robot cleaner 100. In an embodiment, a brief description will be made of the control and driving operations of the robot cleaner 100 on the basis of the controller 180 with reference to FIG. 4.

Figure 4:
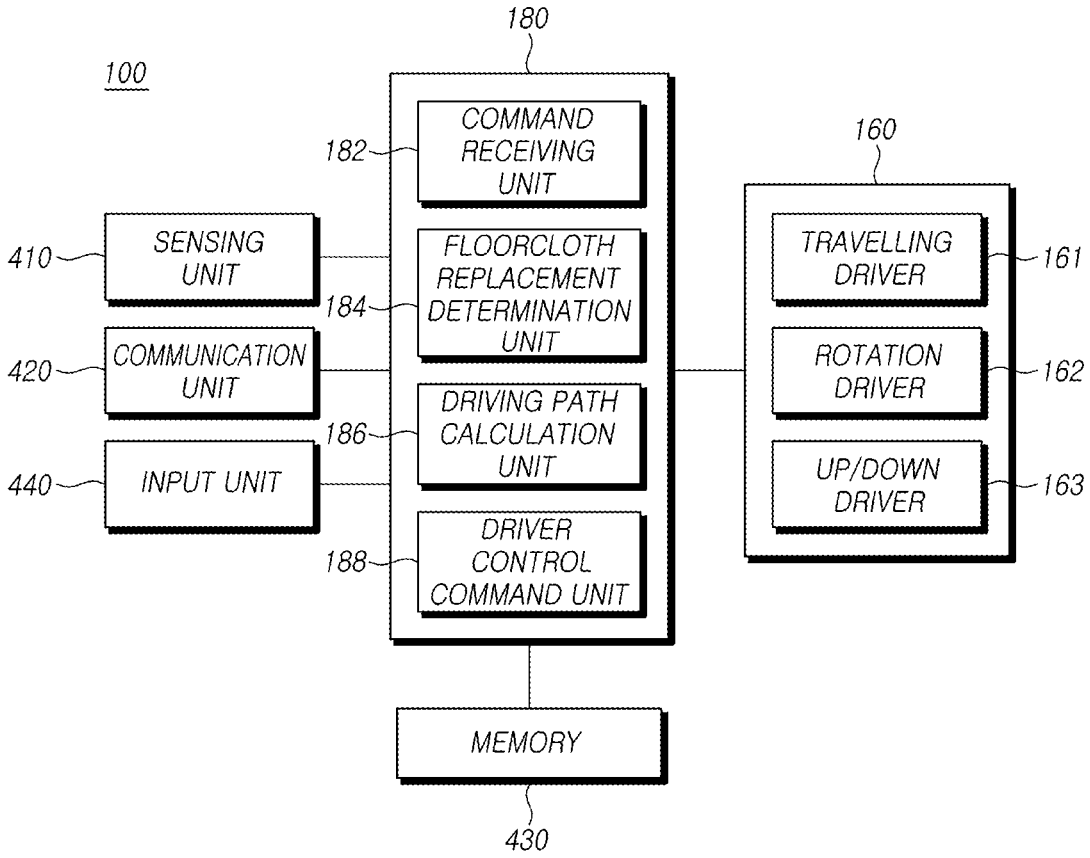
FIG. 4 is a functional block diagram for illustrating the relationship between components on the basis of the control and operation of a robot cleaner according to an embodiment of the disclosure.

FIG. 4 is a functional block diagram for explaining the operational relationship between components on the basis of the control and operation of a robot cleaner according to an embodiment of the present disclosure.

According to an embodiment, the robot cleaner 100 may include a sensing unit 410. The sensing unit 410 may include a plurality of sensors or cameras for detecting the surrounding environment of the robot cleaner 100. The sensing unit 410 may include, for example, a plurality of cameras to capture images in various directions. A range sensor may include, for example, an ultrasonic sensor, a radar sensor, and/or a rider sensor, but the disclosure is not limited thereto. The sensing unit 410 may include, for example, a microphone or an infrared sensor for detecting the surrounding environment. According to an embodiment, the sensing unit 410 may detect a degree of contamination of each floorcloth in use coupled with each floorcloth unit 140 of the robot cleaner 100, and the disclosure is not limited thereto.

In one example, the robot cleaner 100 may include a communication unit 420 that supports transmission and reception of signals to and from the outside. In one example, the communication unit 420 may receive and/or transmit wired or wireless signals in between an external wired or wireless communication system, an external server, and/or other apparatus according to a predetermined wired/wireless communication protocol. In one example, the communication unit 420 may transmit/receive data according to a designated wireless Internet communication protocol such as, e.g., WLAN (Wireless LAN), Wi-Fi (Wireless-Fidelity), Wi-Fi Direct, DLNA (Digital Living Network Alliance), WiBro (Wireless Broadband), WiMAX (World Interoperability for Microwave Access), HSDPA (High Speed Downlink Packet Access), HSUPA (High Speed Uplink Packet Access), LTE (Long Term Evolution), or LTE-A (Long Term Evolution-Advanced). In one example, the communication unit 420 may transmit/receive data according to at least one short-range communication protocol such as, e.g., Bluetooth, radio frequency identification (RFID), infrared data association (IrDA), ultra-wide band (UWB), ZigBee, Near Field Communication (NFC), Wi-Fi, Wi-Fi Direct, Wireless USB (Universal Serial Bus), or the like. In one example, the communication unit 420 may receive a setting data signal input by a user from the user's mobile device, in the form of a wireless signal according to a predetermined wireless communication protocol. In one example, the communication unit 420 may receive information and/or commands for controlling the operation of the robot cleaner 100 from an external server, in the form of a signal according to a predetermined wired/wireless communication protocol. The communication unit 420 may transmit the received various signals to a controller 180 to be described later. In one example, the communication unit 420 may transmit various data generated or obtained in the robot cleaner 100, for example, to a user's mobile device or an external server in the form of a wired/wireless signal according to a predetermined wired/wireless communication protocol.

In one example, the communication unit 420 may include a module for acquiring a position of the robot cleaner 100, for example, a Global Positioning System (GPS) module or a Wi-Fi module. When the robot cleaner 100 uses the GPS module, information on the position of the robot cleaner 100 may be received using a signal transmitted from a GPS satellite. When the robot cleaner 100 uses the Wi-Fi module, information on the position of the robot cleaner 100 may be received based on information on a wireless access point (AP) that transmits and receives a wireless signal with the Wi-Fi module.

According to an embodiment, the robot cleaner 100 may include a memory 430. According to an embodiment, the memory 430 may store data for supporting various functions of the robot cleaner 100. The memory 430 may store, for example, multiple application programs (applications) used in robot cleaner 100, data for use in operating the robot cleaner 100, and/or instructions therefor. At least some of the application programs may be downloaded from an external server through wireless communication. At least some of the application programs may be stored in the memory 430 from the time of its shipment for the basic function of robot cleaner 100. The application program may be stored in the memory 430 and driven by the controller 180 to perform an operation (or function) of the robot cleaner 100. According to some embodiments, the memory 430 may be incorporated into part of a configuration of the controller 180. According to an embodiment, the memory 430 may store information for setting a driving path of the robot cleaner 100.

According to an embodiment, the robot cleaner 100 may include an input unit 440. The input unit 440 may receive, for example, information on an operation mode of the robot cleaner 100 from a user. The input unit 440 may include, for example, a keypad, a dome switch, a touch pad (static or capacitive), a jog wheel, a jog switch, a remote control or the like. Further, in addition to the above-described input unit 440, a user may enter information on the operation mode of the robot cleaner 100 using a mobile device such as e.g., a terminal.

According to an embodiment, the robot cleaner 100 may include a controller 180. According to an embodiment, the controller 180 may control the overall operation of the robot cleaner 100, for example, using a signal transmitted from the sensing unit 410, the communication unit 420, or the input unit 440. Although not shown in detail, the controller 180 may include one or more processors.

According to an embodiment, the controller 180 may include a command receiving unit 182. The command receiving unit 182 may receive a driving-related command input from the outside via the sensing unit 410, the communication unit 420, or the input unit 440. The command receiving unit 182 may receive a command from a user received from the power button 113 and/or the control panel 120 described above. The command receiving unit 182 may receive a respective user instruction/command including an operation on/off instruction, a cleaning start/pause instruction, a cleaning mode setting instruction, or the like.

In an embodiment, the controller 180 may include a floorcloth replacement determination unit 184 for determining whether a floorcloth coupled to the floorcloth unit 140 should be replaced during cleaning of the robot cleaner 100. In an embodiment, the floorcloth replacement determination unit 184 may obtain, for example, a detected result of a contamination sensor (not shown) provided in the sensing unit 410 and then determine whether replacement of a new floorcloth is required according to the obtained information. In an embodiment, the floorcloth replacement determination unit 184 may determine whether a floorcloth is required to be replaced according to a cleaning time elapsed after attaching the current floorcloth to the floorcloth unit 140. In an embodiment, the floorcloth replacement determination unit 184 may determine whether a floorcloth replacement is required according to a command received from the command receiving unit 182.

In an embodiment, the controller 180 may include a driving path calculation unit 186 for calculating a driving path of the robot cleaner 100. In an embodiment, the driving path calculation unit 186 may calculate the driving path of the robot cleaner 100, based on a predetermined algorithm, a detection result detected by various sensors provided in the sensing unit 410, and/or a user command received via the command receiving unit 182. In an embodiment, the driving path calculation unit 186 may calculate the driving path of the robot cleaner 100 in consideration of the detection result from at least one sensor provided in the sensing unit 410.

In an embodiment, when the floorcloth replacement determination unit 184 determines that the floorcloth replacement is required, the driving path calculation unit 186 may calculate the driving path for moving the robot cleaner 100 to a preset position. The floorcloth replacement determination unit 184 may calculate the driving path for driving the robot cleaner 100 to a docking station 200, for example, when it is determined that the floorcloth is required to be replaced.

In an embodiment, the controller 180 may include a driver control command unit 188. In an embodiment, the driver control command unit 188 may generate control commands for controlling each component of the driving unit 160 of the robot cleaner 100, for example, each motor and/or actuator of each driving unit, according to various commands received from the user or the outside through the command receiving unit 182, the detection result detected by various sensors in the sensing unit 410 of the robot cleaner 100, and/or the driving path determined by the driving path calculation unit 186.

In an embodiment, each component of the driving unit 160 may operate according to a command generated by the driver control command unit 188. According to an embodiment, the driving unit 160 may include a travelling driver 161 (e.g., the travelling driver 161 of FIG. 2), a rotation driver 162 (e.g., the rotation driver 162 of FIG. 2), and an up/down driver 163 (e.g., the up/down driver 163 of FIG. 2).

In an embodiment, the driving/movement of the robot cleaner 100 may be controlled according to a command generated by the driver control command unit 188. In an embodiment, each component of the driving unit (e.g., the travelling driver 161) may operate to appropriately control the direction and speed of rotation of the first and second main wheels 131*a* and 131*b* according to the command generated by the driver control command unit 188, so that the robot cleaner 100 can effectually move in a required direction.

In an embodiment, the rotational and/or up/down movement of the floorcloth unit 140 may be controlled according to a command generated by the driver control command unit 188. In an embodiment, the driver control command unit 188 may generate a control command for controlling each component of the driving unit (e.g., the rotation driver 162 or a up/down driver 163), for example, a motor and/or an actuator, so as to move the floorcloth unit 140, based on a command received from the user through the command receiving unit 182 and/or a pre-stored algorithm.

In an embodiment, each component of the driving unit (e.g., the rotation driver 162) may operate to appropriately adjust the rotation speed of each rotation member 141*a* and 141*b* of the floorcloth unit 140, according to a command generated by the driver control command unit 188. In this connection, the strength of wiping with the damp floorcloth of the robot cleaner 100 may be adjusted. In an embodiment, each component of the driving unit (e.g., the up/down driver 163) may be adjusted so that the floorcloth unit 140 ascend or descend in the height direction according to the command generated by the driver control command unit 188. In this case, a distance between the floorcloth unit 140 and the floor may be adjusted.

Figure 5:
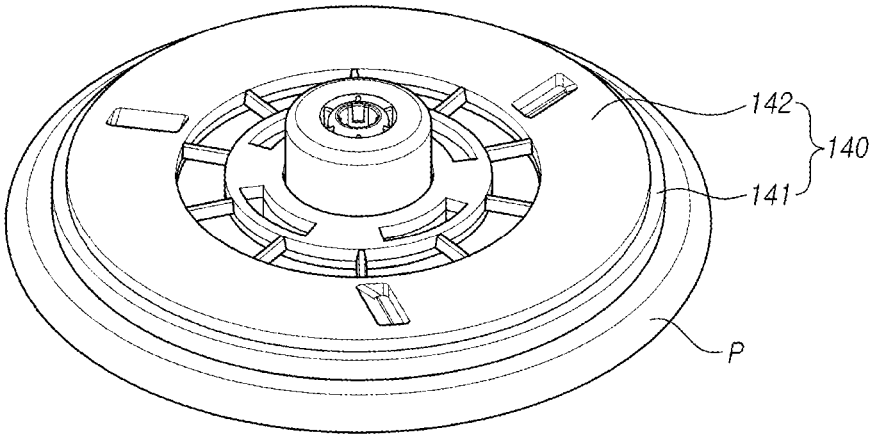
FIG. 5 is a perspective view of a floorcloth unit according to an embodiment of the disclosure.
Figure 6A:
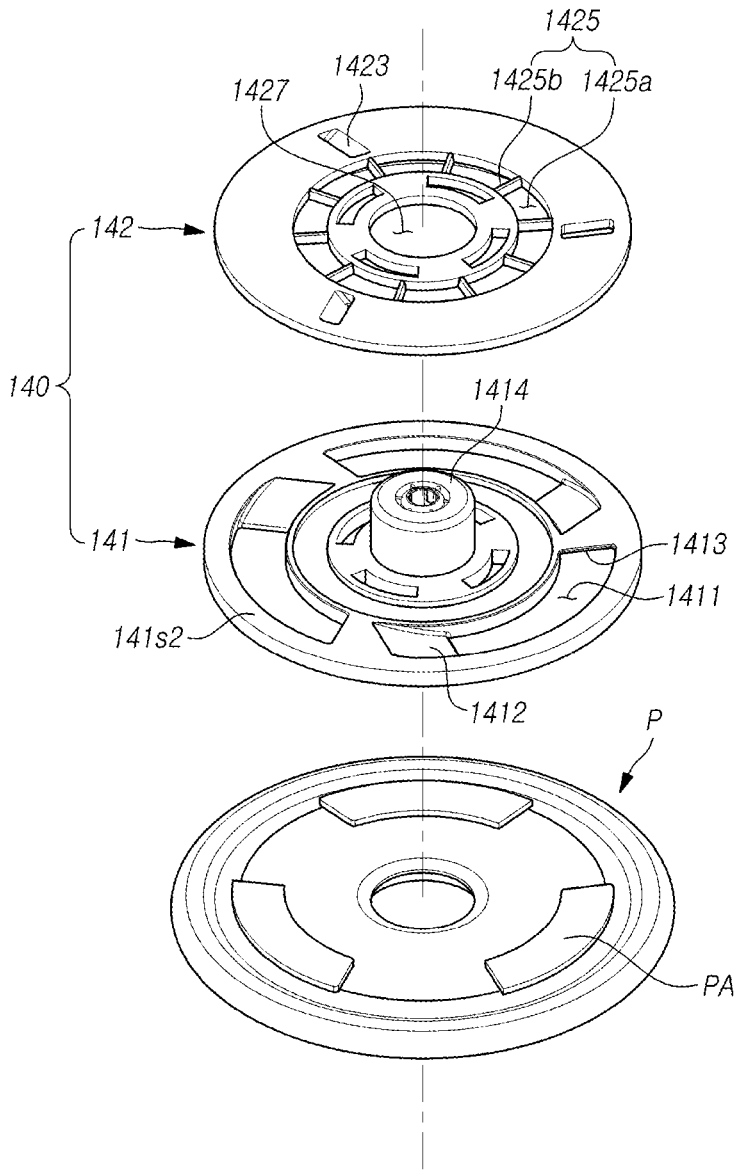
FIG. 6A is an exploded perspective view of a floorcloth unit according to an embodiment of the disclosure, viewed from the top.
Figure 6B:
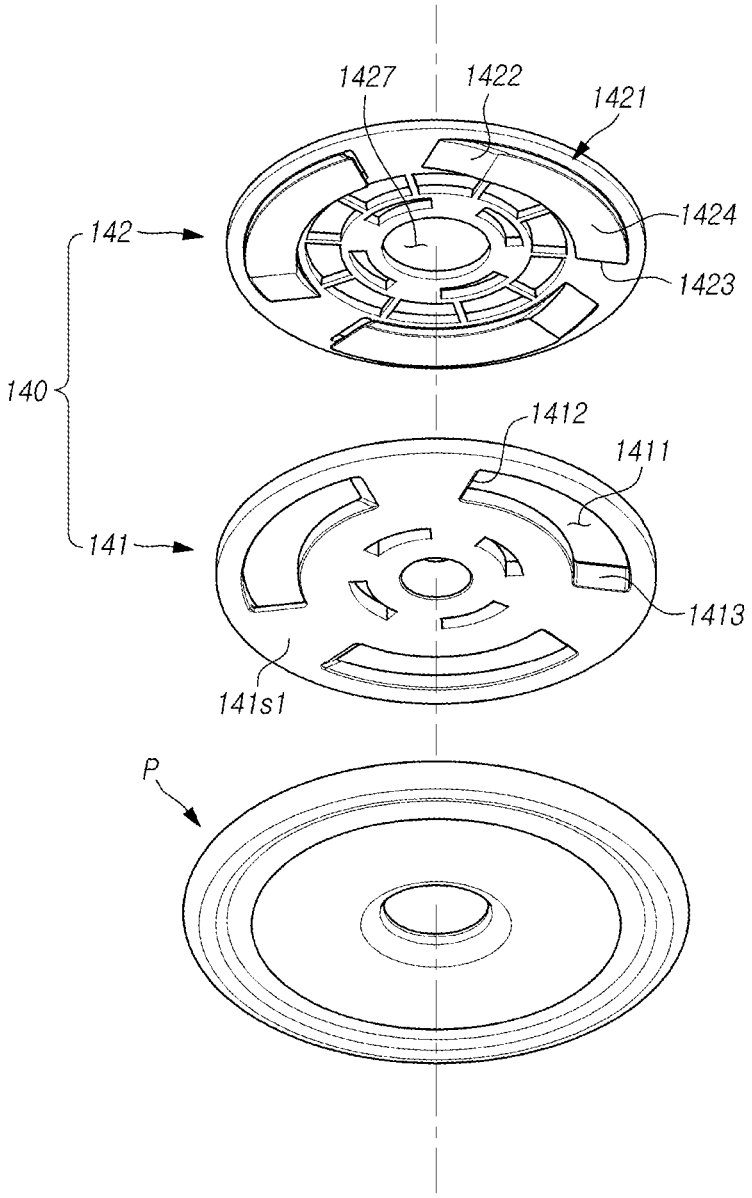
FIG. 6B is an exploded perspective view of a floorcloth unit according to an embodiment of the disclosure, viewed from the bottom.

FIG. 5 is a perspective view of a floorcloth unit according to an embodiment of the present disclosure. FIG. 6A is an exploded perspective view of a floorcloth unit according to an embodiment of the present disclosure, viewed from the top. FIG. 6B is an exploded perspective view of a floorcloth unit according to an embodiment of the present disclosure, viewed from the bottom.

According to an embodiment, an attachment member PA such as e.g., a Velcro or a magnet may be provided on one surface (e.g., an upper surface) of the floorcloth (P), and the floorcloth (P) may be detachably coupled to the floorcloth unit 140 by means of the attachment member PA. Referring to FIGS. 5, 6A, and 6B, in an embodiment, the floorcloth unit 140 may include a rotation member 141 and a floorcloth coupling member 142.

In an embodiment, the rotation member 141 may receive power from the rotation driver (e.g., the rotation driver 162 of FIG. 2) to cause to rotate (e.g., either clockwise or counterclockwise rotation). In an embodiment, the rotation member 141 may receive power from the up/down driver (e.g., the up/down driver 163 of FIG. 2) to cause to ascend or descend. In an embodiment, a hub 1414 connected to a shaft (or a rotation shaft) may be disposed on an upper surface of the rotation member 141 to receive power from the driving unit 160. In an embodiment, the hub 1414 may be integrally formed with a shaft (or a rotation shaft) operatively connected to the rotation driver 162 and/or the up/down driver 163, but the present disclosure is not limited thereto. In an embodiment, the rotation member 141 may transmit the power of the rotation driver 162 and/or the up/down driver 163 transmitted through the shaft to the floorcloth (P) and/or the floorcloth coupling member 142. In this case, the floorcloth (P) and/or the floorcloth coupling member 142 may rotate together with the rotation member 141 or may cause to ascend or descend.

According to an embodiment, the rotation member 141 may be disposed above the floorcloth (P). In an embodiment, the rotation member 141 may have a first surface 141*s*1 disposed to be in contact with the floorcloth (P) and a second surface 141*s*2 opposite to the first surface 141*s*1. The first surface 141*s*1 may be referred to as a lower surface of the rotation member 141, and the second surface 141*s*2 may be referred to as an upper surface of the rotation member 141.

According to an embodiment, one or more openings 1411 may be disposed in the rotation member 141. In an embodiment, the opening 1411 may be formed to pass through the rotation member 141. The opening 1411 may be formed, for example, to penetrate the first surface 141*s*1 and the second surface 141*s*2 of the rotation member 141. In an embodiment, the rotation member 141 may allow the floorcloth (P) on the lower surface side and the floorcloth coupling member 142 on the upper surface side to be coupled through the opening 1411. In an embodiment, the opening 1411 may extend along a circumferential edge of the rotation member 141. In an embodiment, a plurality of openings 1411 may be provided. In an embodiment, a plurality of openings 1411 may be disposed to be spaced apart from each other by a predetermined interval along a circumference of the rotation member 141. The opening 1411 may be referred to as a attaching/detaching groove or hole.

According to an embodiment, the floorcloth coupling member 142 may be disposed on the rotation member 141. The floorcloth coupling member 142 may be disposed on one side of the second surface 141*s*2 of the rotation member 141, for example. In an embodiment, the overall height (or thickness) of the floorcloth coupling member 142 may be substantially greater than the height (or thickness) of the rotation member 141, and the present disclosure is not limited thereto.

According to an embodiment, a floorcloth attaching unit 1421 capable of being detachably coupled to the floorcloth (P) may be disposed in the floorcloth coupling member 142. In an embodiment, the floorcloth attaching unit 1421 may be inserted into the opening 1411 of the rotation member 141 to be detachably coupled to the floorcloth (P). In an embodiment, the floorcloth attaching unit 1421 may be formed to protrude downward from one surface (e.g., the bottom surface) of the floorcloth coupling member 142.

In an embodiment, the floorcloth attaching units 1421 may be provided in the number corresponding to the above-described plurality of openings 1411. In an embodiment, a plurality of floorcloth attaching units 1421 may be arranged to be spaced apart from each other by a predetermined interval along the circumferential direction of the floorcloth coupling member 142. Each of the plurality of floorcloth attaching units 1421 may be formed, for example, to protrude toward each of the plurality of openings 1411 of the corresponding rotation member 141 from the bottom surface of the floorcloth coupling member 142. In an embodiment, each of the plurality of floorcloth attaching units 1421 may be formed in a shape corresponding to each of the plurality of openings 1411 of the rotation member 141. When the floorcloth (P) is mounted onto the robot cleaner 100, each of the plurality of floorcloth attaching units 1421 may be inserted and received into each of the plurality of openings 1411.

Referring to FIG. 6A, in an embodiment, each opening 1411 of the rotation member 141 may include a first inclined portion 1412 that guides to cause the floorcloth attaching unit 1421 of the floorcloth coupling member 142 inserted into each opening 1411 to rise from the opening 1411 and exit the opening 1411, when detaching the floorcloth (P) of the robot cleaner 100. In an embodiment, the first inclined portion 1412 may be formed on one side of the opening 1411 extending along the circumferential direction of the rotation member 141, for example, near one end of the opening 1411 in its circumferential direction. In an embodiment, the first inclined portion 1412 may be formed to extend upward from an inner position of the opening 1411 (e.g., a more inward position in an inner empty space than the one end of the opening 1411 in the circumferential direction) toward the second surface 141*s*2. For example, referring to FIG. 6A, the first inclined portion 1412 may be located near a downstream end of each opening 1411 along a clockwise direction (when viewed from the top). For example, referring to FIG. 6A, the first inclined portion 1412 may be formed to extend upward from its under part (e.g., a lowermost position recessed toward the first surface 141*s*1 from the second surface 141*s*2) toward the end of the second surface 141*s*2, at a more inward position of the opening 1411 upstream along the clockwise direction (when viewed from the top) than the respective end of the opening 1411.

Referring to FIG. 6B, in an embodiment, each floorcloth attaching unit 1421 of the floorcloth coupling member 142 may include a second inclined portion 1422 disposed to face the first inclined portion 1412 above the first inclined portion 1412 of the opening 1411, when the floorcloth attaching unit 1421 is inserted into the corresponding opening 1411. Referring to FIG. 6B, in an embodiment, the second inclined portion 1422 may be located on one side of the floorcloth attaching unit 1421, for example, near an upstream end of the floorcloth attaching unit 1421 along the clockwise direction (when viewed from the bottom side). For example, referring to FIG. 6B, the second inclined portion 1422 may be formed to extend upward from a position more protruding downward downstream along the clockwise direction (viewed from the bottom side) than the respective end of the floorcloth attaching unit 1421, toward the bottom surface of the floorcloth coupling member 142 located above.

Referring to FIG. 6B, in an embodiment, each opening 1411 of the rotation member 141 may include a first reverse inclined portion 1413 for strengthening the coupling between the rotation member 141 and the floorcloth coupling member 142, during the cleaning operation of the robot cleaner 100. In an embodiment, the first reverse inclined portion 1413 may be formed on one side of the opening 1411 extending along the circumferential direction of the rotation member 141, for example, near the opposite end of the end where the first inclined portion 1412 is formed. In an embodiment, the first reverse inclined portion 1413 may be formed to extend downward from the second surface 141*s*2 of the end of the opening 1411 toward an outer position of the opening 1411 (e.g., an outer position along the circumferential direction away from the empty space in the opening 1411). For example, referring to FIG. 6B, the first reverse inclined portion 1413 may be located near a downstream end of each opening 1411 in the clockwise direction (viewed from the bottom). For example, referring to FIG. 6B, the first reverse inclined portion 1413 may be formed to extend downward from the second surface 141*s*2 near the end of each opening 1411 toward the outer position of the opening 1411 more downstream than the corresponding end along the clockwise direction (viewed from the bottom).

According to an embodiment, each floorcloth attaching unit 1421 of the floorcloth coupling member 142 may include a second reverse inclined portion 1423 for strengthening the coupling between the rotation member 141 and the floorcloth coupling member 142, during the cleaning operation of the robot cleaner 100. Referring to FIG. 6B, in an embodiment, the second reverse inclined portion 1423 may be disposed to face the first reverse inclined portion 1413 under the first reverse inclined portion 1413 of the opening 1411, when the rotation member 141 and the floorcloth coupling member 142 rotate in a state of the floorcloth attaching unit 1421 being inserted into the corresponding opening 1411. Referring to FIG. 6B, in an embodiment, the second reverse inclined portion 1423 may be disposed on one side of the floorcloth attaching unit 1421, for example, near the opposite end of the end at which the second inclined portion 1422 is disposed. Referring to FIG. 6B, in an embodiment, the second reverse inclined portion 1423 may be formed to extend downward, at a position of the end of the floorcloth attaching unit 1421, from the bottom surface of the floorcloth coupling member 142 toward a position protruding downward downstream along the clockwise direction (viewed from the bottom).

In an embodiment, when the robot cleaner 100 cleans the floor surface (for example, when the floorcloth unit 140 rotates in a regular direction), the second reverse inclined portion 1423 of the floorcloth attaching unit 1421 and the first reverse inclined portion 1413 of the rotation member 141 may engage each other and come into close contact with each other. Accordingly, a force (e.g., a vertical force) acting in the direction of the bottom surface to be cleaned, the force being transmitted from the driving unit 160 through the shaft to the rotation member 141, may be transmitted to the floorcloth coupling member 142 and the rotation member 141, respectively. Due to this force, a certain pressure may be applied to the bottom surface through the floorcloth (P), while the cleaning is performed by the robot cleaner 100, so that the friction between the floorcloth (P) and the cleaned surface can be increased, thereby enhancing the performance of cleaning for the robot cleaner 100.

According to an embodiment, an attachment member 1424 such as e.g., a Velcro or a magnet may be disposed on one surface (e.g., a bottom surface) of the floorcloth attaching unit 1421. In an embodiment, the attachment member 1424 may be formed in a shape corresponding to the one surface of the floorcloth attaching unit 1424. The attachment member 1421 of the floorcloth attaching unit 1421 may be coupled to an attachment member PA provided on the floorcloth (P).

According to an embodiment, a stopper coupling 1425 may be disposed in the floorcloth coupling member 142. In an embodiment, the stopper coupling 1425 may be configured to be coupled with a stopper (e.g., a stopper 1111 of FIG. 7 or a stopper 1112 of FIG. 9) to be described later. Referring to FIG. 6A, in an embodiment, the stopper coupling 1425 may be arranged to surround a hub hole 1427 into which a hub 1414 of the rotation member 141 is inserted to pass through. In an embodiment, the stopper coupling 1425 may be disposed inside the floorcloth attaching unit 1421.

According to an embodiment, the stopper coupling 1425 may include a plurality of stopper holes 1425*a* and a plurality of stopper ribs 1425*b*. In an embodiment, the plurality of stopper holes 1425*a* may be disposed to be spaced apart from each other by a predetermined interval along a virtual circle about the hub hole 1427. A stopper rib 1425*b* may be disposed between one of a plurality of stopper holes 1425*a*, and the stopper hole 1425*a* adjacent to the stopper hole 1425*a*. Stoppers 1111 and 1112 (to be described later) may be inserted into the plurality of stopper holes 1425*a*, respectively, when the floorcloth (P) mounted on the robot cleaner 100 is detached. In this context, the movement of the floorcloth coupling member 142 may be limited by these stoppers 1111 and 1112 inserted into the stopper hole 1425*a*. Hereinafter, a state in which the stoppers 1111 and 1112 are released from the stopper coupling 1425 may be referred to as a first state. Further, a state in which the stoppers 1111 and 1112 are coupled with the stopper coupling 1425 to restrict rotation of the floorcloth coupling member 142 may be referred to as a second state.

Figure 7:
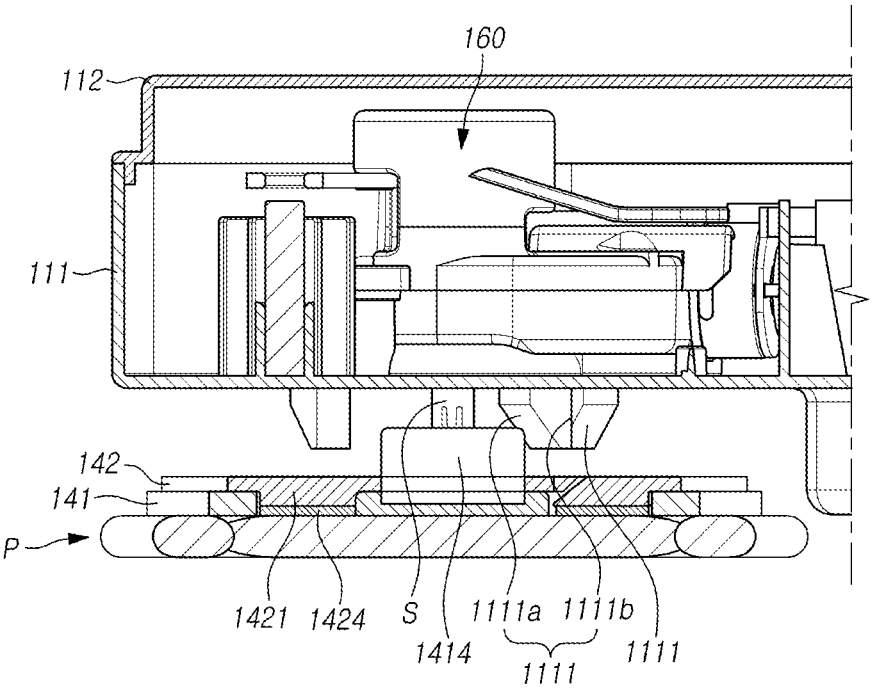
FIG. 7 is a partial cross-sectional view of an exemplary robot cleaner taken along a line A-A shown in FIG. 2.
Figure 8:
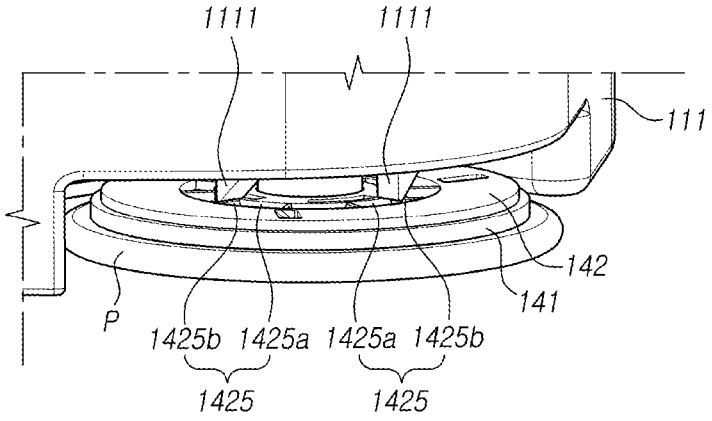
FIG. 8 is a partial perspective view for explaining an interference relationship between a floorcloth attaching unit and a stopper shown in FIG. 7.

FIG. 7 is a partial cross-sectional view of an exemplary robot cleaner taken along a line A-A illustrated in FIG. 2. FIG. 8 is a partial perspective view illustrating an interference relationship between the floorcloth coupling member and the stopper illustrated in FIG. 7.

Referring to FIGS. 7 and 8, in an embodiment, the robot cleaner 100 may include a stopper 1111 configured to be coupled to the floorcloth coupling member 142 to limit the rotation of the floorcloth coupling member 142.

In an embodiment, the stopper 1111 may be disposed underneath the cleaner body 111 of the robot cleaner 100. The stopper 1111 may be disposed on aback surface of the cleaner body 111, for example. In an embodiment, a plurality of stoppers 1111 may be provided. The plurality of stoppers 1111 may be arranged in a circular shape so as to surround a shaft S of the driving unit 160 on the back surface of the cleaner body 111. The plurality of stoppers 1111 may be arranged to be spaced apart from each other by a predetermined interval.

In an embodiment, each of the plurality of stoppers 1111 may include an insert that can be inserted through the stopper hole 1425*a* of each stopper coupling 1425 of the floorcloth coupling member 142, so as to limit the movement of the floorcloth coupling member 142, when detaching/attaching the floorcloth (P) of the robot cleaner 100. In an embodiment, a plurality of stoppers 1111 may be formed to protrude downward from the back surface of the cleaner body 111. In an embodiment, each insert of a plurality of stoppers 1111 may be inserted into the stopper coupling 1425 along a predetermined direction (e.g., a vertical downward direction). In an embodiment, each insert of the plurality of stoppers 1111 may have an inclined surface inclined with respect to the predetermined direction. In an embodiment, each insert of the plurality of stoppers 1111 may be configured to have an inclined surface 1111*a* and a vertical surface 1111*b*. In an embodiment, although the inclined surface 1111*a* is not shown in this drawing, the stopper 1111 may be configured to ascend or descend by a stopper moving unit such as an actuator.

According to an embodiment, as shown in FIG. 8, the stopper 1111 may be positioned close to the stopper hole 1425*a* of the stopper coupling 1425 of the floorcloth coupling member 142, due to rising of the rotation member 141 or falling of the stopper 1111. An interfering surface between the stopper 1111 and the stopper rib 1425*b* may be minimized by the inclined surface 1111*a* provided in the stopper 1111, and the stopper 1111 may be inserted into the stopper hole 1425*a*, by rising or falling of the rotation member 141 or the stopper 1111 by a predetermined height.

Figure 9:
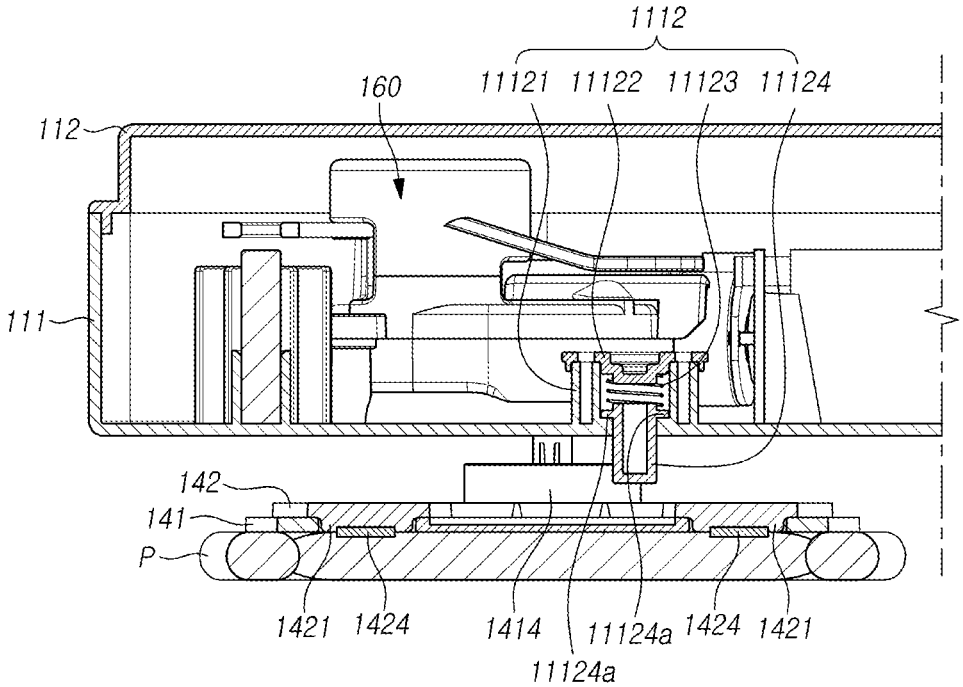
FIG. 9 is a partial cross-sectional view of a robot cleaner according to an embodiment of the disclosure.
Figure 10:
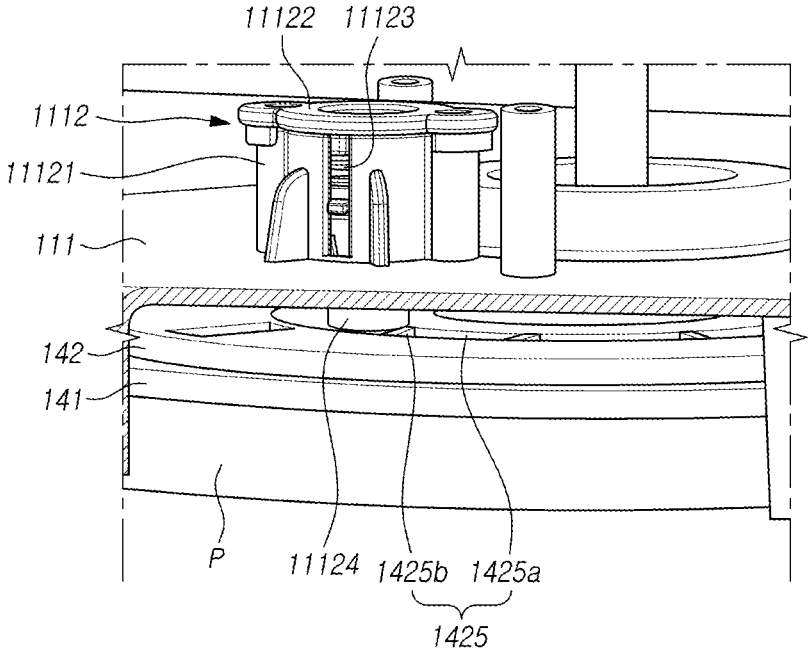
FIG. 10 is a partial perspective view for explaining an interference relationship between a floorcloth attaching unit and a stopper shown in FIG. 9.

FIG. 9 is a partial cross-sectional view of a robot cleaner according to an embodiment of the present disclosure. FIG. 10 is a partial perspective view illustrating an interference relationship between the floorcloth attaching unit and the stopper illustrated in FIG. 9.

Referring to FIGS. 9 and 10, in an embodiment, the robot cleaner 100 may include a stopper 1112 configured to be coupled to the floorcloth coupling member 142 to limit the rotation of the floorcloth coupling member 142.

In an embodiment, a stopper 1112 may be disposed underneath the robot cleaner 100. At least part of the stopper 1112 may be disposed on the back surface of the cleaner body 111, for example.

In an embodiment, at least part of the stopper 1112 may be inserted through the stopper hole 1425*a* of the stopper coupling 1425 of the floorcloth coupling member 142, so as to limit the movement of the floorcloth coupling member 142, when detaching and attaching the floorcloth (P) of the robot cleaner 100. In an embodiment, at least part of the stopper 1112 may be formed to protrude downward from the back surface of the cleaner body 111.

According to an embodiment, the stopper 1112 may include a stopper body 11121, a stopper cap 11122, an elastic member 11123, and a stopper protrusion 11124.

In an embodiment, the stopper body 11121 may be formed to extend upward from the inner surface of the cleaner body 111. In an embodiment, the stopper body 11121 may be formed to have an opening at an upper side and/or a lower side and have a substantially hollow cylinder shape.

In an embodiment, the stopper cap 11122 may be coupled to the stopper body 11121 at an upper side of the stopper body 11121. The stopper cap 11122 may be configured to cover an upper opening of the stopper body 11121.

In an embodiment, the elastic member 11123 may have one end connected to the stopper cap 11122 and the other end connected to the stopper protrusion 11124.

In an embodiment, at least part of the stopper protrusion 11124 may be accommodated inside the stopper body 11121 and/or the robot cleaner 100 through a lower opening of the stopper body 11121. A separation prevention part 11124*a* may be formed at an inner end of the stopper protrusion 11124 connected to the elastic member 11123 to prevent the stopper protrusion 11124 from escaping to the outside.

As shown in FIG. 10, when the rotation member 141 rises, the stopper protrusion 11124 may come into contact with the stopper rib 1425*b* of the stopper coupling 1425 of the floorcloth coupling member 142. In this case, the elastic member 11123 connected to the stopper protrusion 11124 may be compressed, and at least part of the stopper protrusion 11124 may be accommodated within the cleaner body 111 of the robot cleaner 100. The rotation member 141 may further ascend by a predetermined height for detaching or attaching the floorcloth (P), and the stopper protrusion 11124 may be inserted into the stopper hole 1425*a*. The shape of the stopper protrusion 11124 abutting on the stopper rib 1425*b* of the floorcloth coupling member 142 may not be limited. For example, the stopper protrusion 11124 may be formed in a cylindrical shape.

Figure 11:
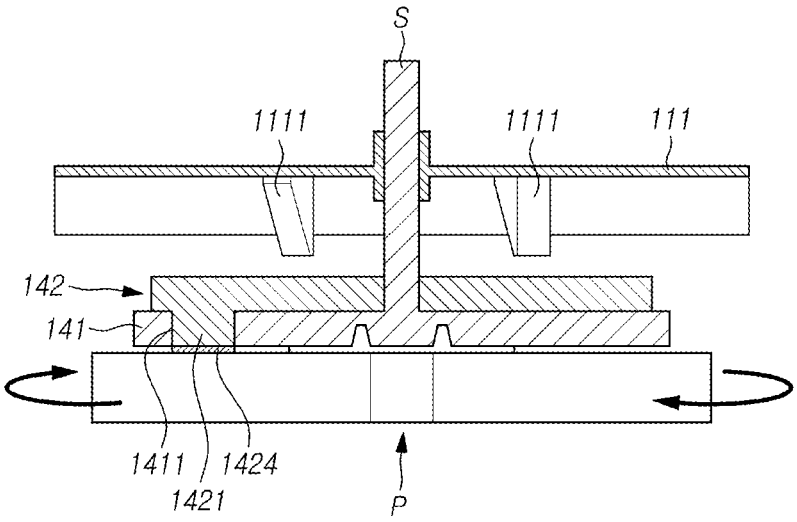
FIG. 11 is a view for explaining a floorcloth mounting state of a robot cleaner in an embodiment of the disclosure.
Figure 12:
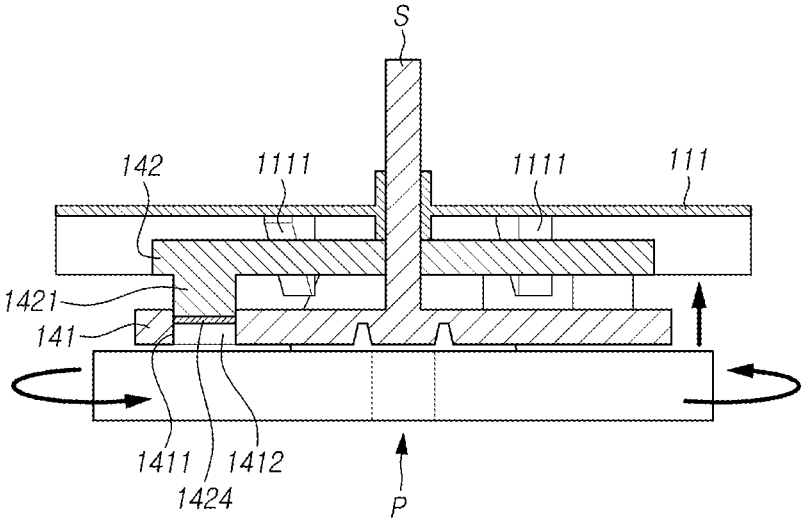
FIG. 12 is a view for explaining an attaching/detaching state of a floorcloth of a robot cleaner in an embodiment of the disclosure.

FIG. 11 is a view for explaining an operating state in which a floorcloth is mounted onto a robot cleaner according to an embodiment of the present disclosure. FIG. 12 is a view for explaining an operating state in which a floorcloth is detached from a robot cleaner according to an embodiment of the present invention.

Referring to FIG. 11, description is made of an operation state in which the floorcloth (P) is mounted onto the robot cleaner 100. As illustrated in FIG. 11, when the rotation member 141 rotates (for example, a regular rotation for a cleaning operation) in a first state, the floorcloth attaching unit 1421 of the floorcloth coupling member 142 may be maintained in the opening 1411 of the rotation member 141. In this case, a coupling state between the attachment member 1424 of the floorcloth attaching unit 1421 and the floorcloth (P) may be maintained. While the rotation member 141 make regular rotation in a first rotation direction (e.g., in the clockwise direction when the rotation member 141 is viewed from the above, or in a direction where the first reverse inclined portion 1413 of the rotation member 141 approaches the second reverse inclined portion 1423 of the floorcloth attaching unit 1421), the floorcloth coupling member 142 coupled to the rotation member 141 and the floorcloth (P) coupled to the floorcloth coupling member 142 may be regularly rotated together with the rotation member 141. Accordingly, foreign substances adhered onto the floor surface to be cleaned may be removed by the rotation of the floorcloth (P).

Referring to FIG. 12, an operation state in which the floorcloth (P) is detached from the robot cleaner 100 will be described. As shown in FIG. 12, as the rotation member 141 ascends or the stopper 1111 descends, the stopper 1111 may be in a second state in which the stopper 1111 is inserted passing through the stopper hole 1425*a* of the stopper coupling 1425. In such a case, the movement of the floorcloth coupling member 142 may be limited to within a predetermined section formed by the stopper hole 1425*a*. In the second state, when the rotation member 141 rotates in a second rotating direction opposite to the first rotation direction (e.g., in the counterclockwise direction when the rotation member 141 is viewed from the above or in a direction where the first reverse inclined portion 1413 of the rotation member 141 moves away from the second reverse inclined portion 1423 of the floorcloth attaching unit 1421), a free rotation of the floorcloth coupling member 142 is interrupted, and the floorcloth attaching unit 1421 of the floorcloth coupling member 142 may escape from the opening 1411 of the rotation member 141. In an embodiment, when the rotation member 141 makes a reverse rotation in a second rotation direction in the second state, as described above, the second inclined portion 1422 of the floorcloth attaching unit 1421 may ascend upward along the first inclined portion 1412 of the opening 1411 of the rotation member 141 and may escape the opening 1411. As the attachment member 1424 of the floorcloth attaching unit 1421 is released and separated from the floorcloth (P), the floorcloth (P) coupled to the floorcloth attaching unit 1421 may be detached from the robot cleaner 100 to be separated downward.

Figure 13:
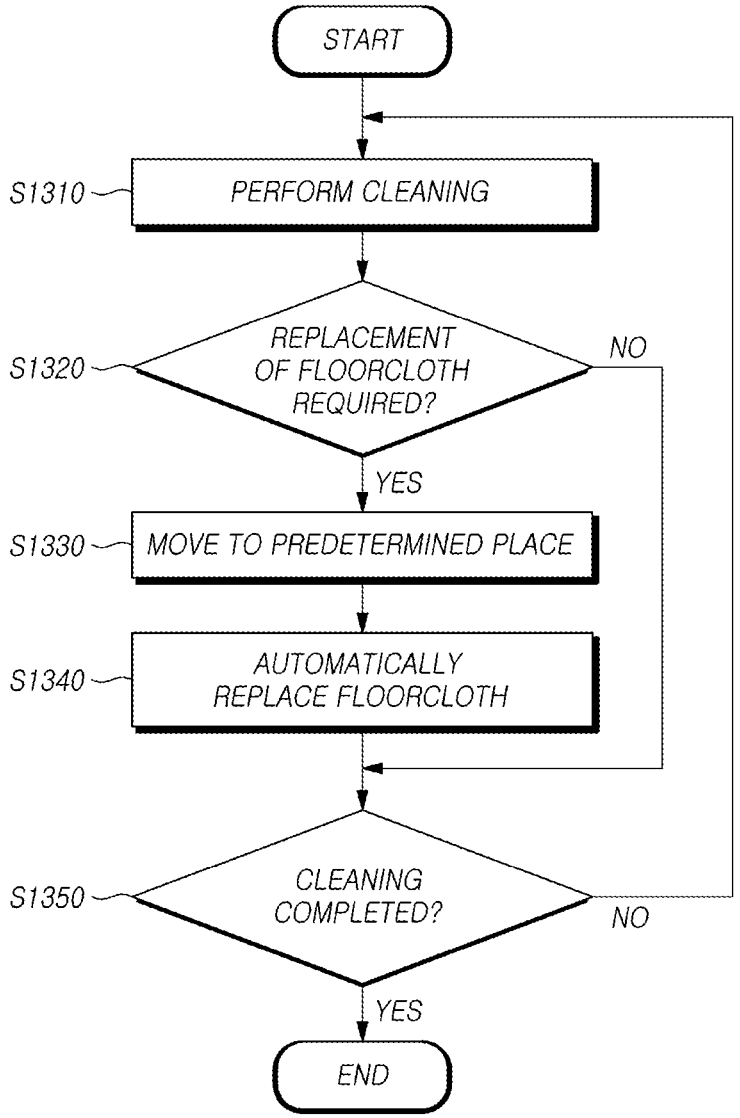
FIG. 13 is a control flowchart illustrating a method of controlling an operation of a robot cleaner according to an embodiment of the present disclosure.
Figure 14:
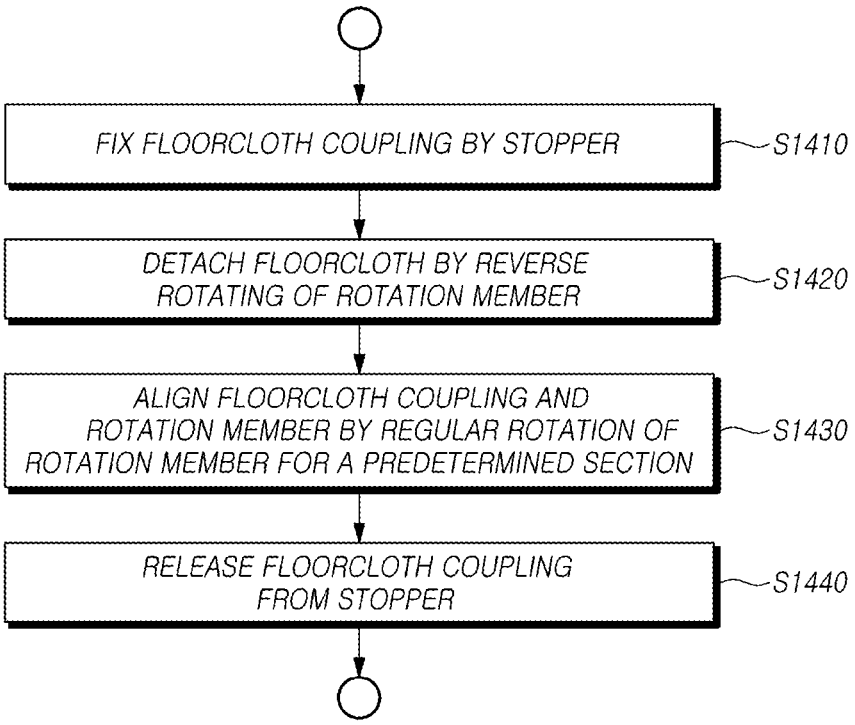
FIG. 14 is a control flowchart for explaining a floorcloth replacement process of a robot cleaner in an embodiment of the disclosure.
Figure 15:
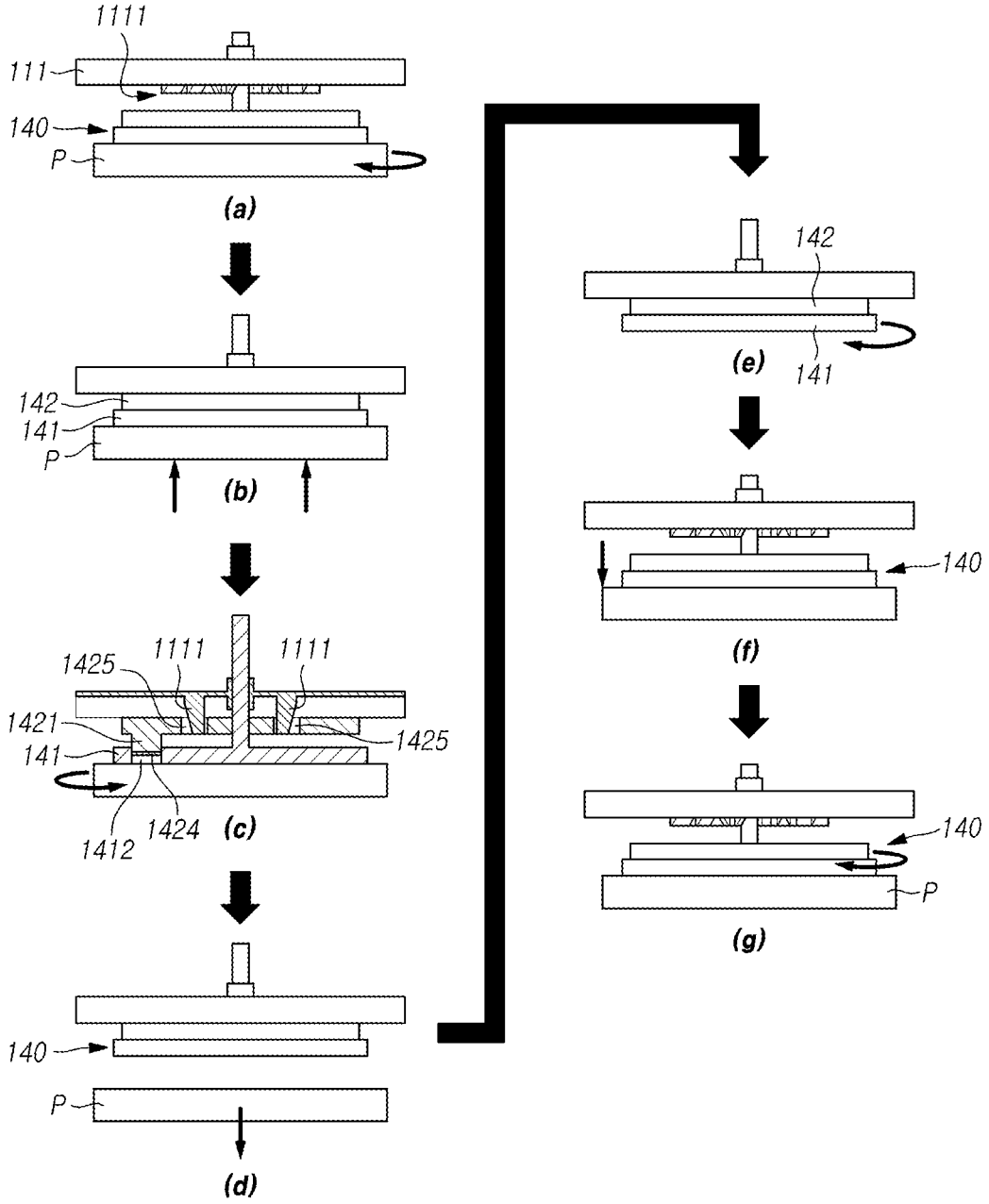
FIG. 15 is an operational flowchart for explaining a floorcloth replacement process of a robot cleaner in an embodiment of the disclosure.

FIG. 13 is a control flowchart illustrating a method of controlling an operation of a robot cleaner according to an embodiment of the present disclosure. FIG. 14 is a control flowchart for explaining a floorcloth replacement process of a robot cleaner in an embodiment of the disclosure. FIG. 15 is an operational flowchart for explaining a floorcloth replacement process of a robot cleaner in an embodiment of the disclosure.

Referring to FIGS. 13 to 15, a method of operating a robot cleaner 100 may include performing a cleaning operation (S1310). In an embodiment, while the cleaning operation is performed, the controller 180 may control the operation of the travelling driver 161 to move the robot cleaner 100 along an appropriate driving path. In an embodiment, while the cleaning operation is in progress, the controller 180 may rotate the floorcloth unit 140 adjacent to the floor surface by controlling the operations of the rotation driver 162 and/or the up/down driver 163. For example, as shown in FIG. 15(*a*), the robot cleaner 100 may cause the floorcloth unit 140 to regularly rotate in the first rotation direction to remove foreign substances adhered onto the floor surface, using the friction force according to the rotation of the floorcloth (P).

According to an embodiment, the method of operating the robot cleaner 100 may include determining whether the floorcloth (P) mounted onto the floorcloth unit 140 disposed adjacent to the floor surface, which floorcloth is being currently used for cleaning, should be replaced (S1320). In an embodiment, such a determination may be made by determining whether a degree of contamination of the floorcloth (P) is higher than a certain level, using a contamination detection sensor separately provided in the robot cleaner 100. In an embodiment, such a determination may be made, based on timer information, for example, by the robot cleaner 100 determining whether a time duration for cleaning the floor surface using the currently mounted floorcloth (P) has exceeded a predetermined standard. In an embodiment, the robot cleaner 100 may determine whether replacement of the floorcloth is required using a floorcloth replacement period preset by a user. For example, in case where the user set the floorcloth replacement period to one hour, the robot cleaner 100 may determine that the floorcloth (P) is required to be replaced, for example, if it is determined that the usage time of the currently mounted floorcloth (P) has reached one hour.

According to an embodiment, when it is determined that a replacement of the floorcloth (P) is required in S1320, the method of operating the robot cleaner 100 may include moving to a predetermined place for replacement of the floorcloth (P) in S1330. In an embodiment, the predetermined place may be, for example, a place designated by a user. In an embodiment, the designated place may be a place where the robot cleaner 100 performs charging (e.g., a docking station 200 in FIG. 16 or a docking station 200' in FIG. 17) or adjacent to the place, and the present disclosure is not limited thereto.

According to an embodiment, the method of operating the robot cleaner 100 may include a process of automatically replacing the floorcloth (P) (S1340).

In an embodiment, the robot cleaner 100 may perform an operation of transitioning to a second state in which the motion of the floorcloth coupling member 142 is restricted through the stoppers 1111 and 1112 (S1410). For example, as shown in FIG. 15(*b*), the robot cleaner 100 may perform an operation of moving the rotation member 141 upward, wherein the movement of the floorcloth coupling member 142 may be restricted within a section formed by the stopper hole 1425*a*, as at least part of the stopper 1111 is inserted into the stopper hole 1425*a* of the stopper coupling 1425. For example, although not specifically illustrated herein, the robot cleaner 100 may perform an operation of moving the stopper 1111 downward, wherein the movement of the floorcloth coupling member 142 may be limited within the section formed by the stopper hole 1425*a*, as the at least part of the stopper 1111 is inserted into the stopper hole 1425*a* of the stopper coupling 1425.

Subsequent to S1410, in an embodiment, the robot cleaner 100 may perform an operation of detaching the currently mounted floorcloth (P) by reverse rotating the rotation member 141 in the second rotation direction in the second state (S1420). For example, as shown in FIGS. 15(*c*) and 15(*d*), when the rotation member 141 is rotated in the second rotation direction in the second state that the movement of the floorcloth coupling member 142 is limited by the stopper 1111, the rotation of the floorcloth coupling member 142 may be restricted within a predetermined limited section of the stopper hole 1425*a*, and the floorcloth attaching unit 1421 of the floorcloth coupling member 142 may exit the opening 1411, ascending along the first inclined portion 1412 of the rotation member 141. As such, the attachment member 1424 of the floorcloth coupling member 142 may be separated from the floorcloth (P), and the currently mounted floorcloth (P) may be detached from the floorcloth unit 140 to be separated downward.

After S1420, in an embodiment, the robot cleaner 100 may perform an operation of aligning the arrangement of the rotation member 141 and the floorcloth coupling member 142 (S1430). For example, as illustrated in FIG. 15(*e*), when the rotation member 141 is caused to regularly rotate for a predetermined section in the first rotation direction while maintaining the second state of the stopper 1111 being inserted into the stopper hole 1425*a* of the stopper coupling 1425, the floorcloth attaching unit 1421 of the floorcloth coupling member 142 may be inserted into the opening 1411 of the rotation member 141 again.

After S1430, in an embodiment, the robot cleaner 100 may perform an operation of releasing the coupling of the floorcloth coupling member 142 from the stoppers 1111 and 1112 (S1440). For example, as shown in FIG. 15(*f*), the robot cleaner 100 may perform an operation of moving the rotation member 141 downward, wherein the floorcloth coupling member 142 may be free to move, as the stopper 1111 inserted into the stopper hole 1425*a* of the stopper coupling 1425 exits from the stopper hole 1425*a*. In an embodiment, when the rotation member 141 moves downward while the floorcloth attaching unit 1421 of the floorcloth coupling member 142 is inserted and accommodated in the opening 1411 of the rotation member 141, a fresh floorcloth disposed underneath the floorcloth unit 140 may be newly attached to the floorcloth attaching unit 1421. Thereafter, as shown in FIG. 15(*g*), the robot cleaner 100 may resume the cleaning operation by causing to normally rotate the floorcloth unit 140.

According to an embodiment, the method of operating the robot cleaner 100 may include an operation of determining whether the cleaning is completed (S1350). For example, the robot cleaner 100 may determine whether the cleaning is completed, based on determining various terminating conditions such as e.g., a user's termination command or completion of cleaning a preset cleaning area. When it is determined that the cleaning has not yet been completed, the robot cleaner 100 may return to the operation S1310, and may again execute the process after the operation S1310. The robot cleaner 100 may determine that the cleaning has been completed after finishing a predetermined cleaning schedule and then terminate the cleaning operation. According to an embodiment, the operation of determining whether the cleaning has been completed or not may be performed in between the above-described operations, respectively.

Figure 16:
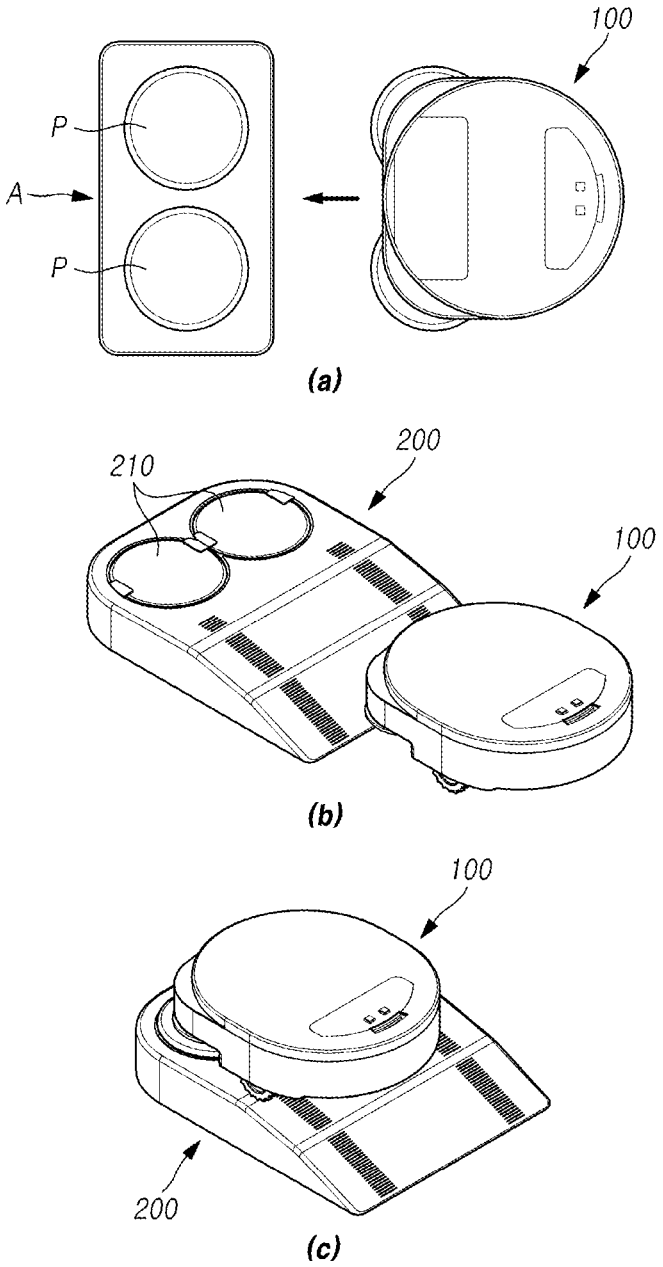
FIG. 16 is an exemplary view illustrating a process of attaching and detaching a floorcloth of a robot cleaner at a predetermined position according to an embodiment of the disclosure.
Figure 17:
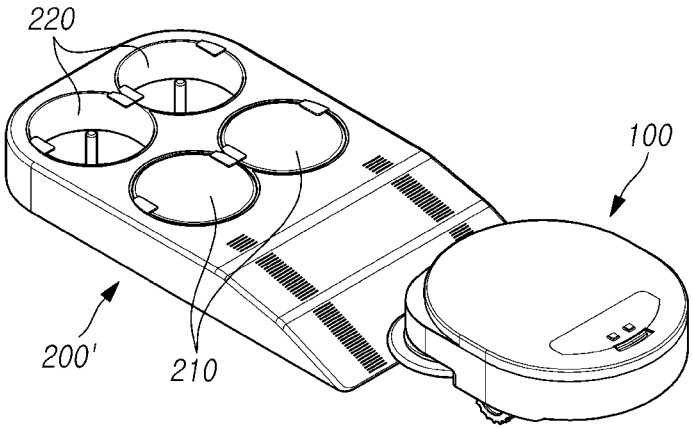
FIG. 17 is an exemplary view illustrating a process of attaching and detaching a floorcloth of a robot cleaner in a docking station according to an embodiment of the disclosure.
Figure 17:
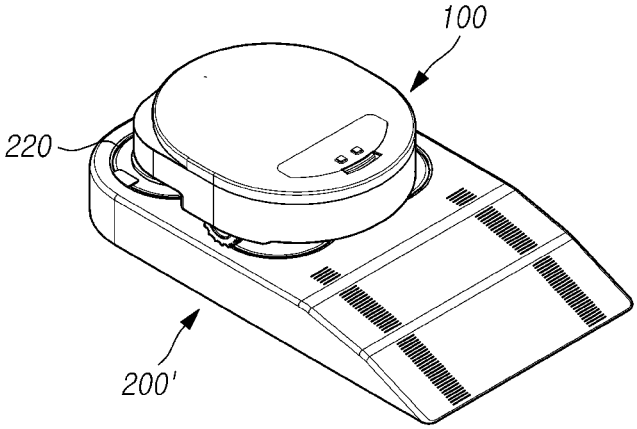
Figure 17:
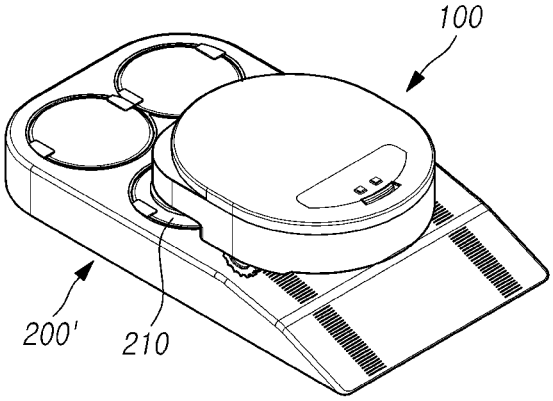

FIG. 16 is an exemplary diagram illustrating a process of attaching and detaching a floorcloth of a robot cleaner at a predetermined position according to an embodiment of the present disclosure. FIG. 17 is an exemplary view illustrating a process of attaching and detaching a floorcloth of a robot cleaner in a docking station according to an embodiment of the present disclosure.

As shown in FIG. 16(*a*), in an embodiment, when it is determined that replacement of the floorcloth is required, by the control method described in FIGS. 13 and 14, the robot cleaner 100 may move to a predetermined position (A) preset by a consumer, such as e.g., next to a bathroom or in front of a laundry room and then perform the detaching operation as described above, in order to detach the floorcloth (P) mounted underneath.

Thereafter, as shown in FIG. 16(*b*) and FIG. 16(*c*), the robot cleaner 100 may move to the docking station 200 having a floorcloth supply unit 210 in which a fresh floorcloth (P) is accommodated, so that it is positioned in place and then, the rotation member 141 may descend downward to mount the fresh floorcloth (P) onto the floorcloth unit 140 located beneath. Then, the robot cleaner 100 may leave the docking station 200 and resume the cleaning operation.

Unlike FIG. 16, referring to FIG. 17, the robot cleaner 100 may perform a floorcloth attachment/detachment process integrally at the docking station 200'. In an embodiment, when it is determined that replacement of the floorcloth is required by the control method described above with reference to FIGS. 13 and 14, the robot cleaner 100 may move to the docking station 200' integrally equipped with both the floorcloth supply unit 210 containing a new floorcloth (P) and a floorcloth collection unit 220 for collecting the used floorcloth (P). According to an embodiment, as illustrated in FIG. 17(*a*), the floorcloth collection unit 220 may be located more downstream than the floorcloth supply unit 210 with respect to an entry direction of the robot cleaner 100 toward the docking station 200', and the present disclosure is not limited thereto.

As shown in FIG. 17(*b*), the robot cleaner 100 reaching the docking station 200' may separate the floorcloth (P) from the floorcloth unit 140 located underneath, by performing an operation of detaching the floorcloth (P) after being positioned in place on the floorcloth collection unit 220. In an embodiment, the floorcloth (P) separated from the floorcloth unit 140 may be accommodated in the floorcloth collection unit 220 below.

Thereafter, as shown in FIG. 17(*c*), the robot cleaner 100 may move backward and be positioned in place onto the floorcloth supply unit 210, and then, perform an operation of attaching the fresh floorcloth (P) to attach the fresh floorcloth (P) supplied from the floorcloth supply unit 210 onto the floorcloth unit 140. Then, the robot cleaner 100 may leave the docking station 200' to resume the cleaning operation.

The terms used in the disclosure are used only to describe specific embodiments and are not intended to limit the disclosure thereto. For example, a component expressed in a singular form should be understood as a concept including multiple components unless the context explicitly dictates only such a singular form. As used herein, each of the phrases such as "A or B", "at least one of A and B", "at least one of A or B", "A, B or C", "at least one of A, B and C", and "at least one of A, B, or C" may include any one of the items enumerated together in a corresponding one of the phrases, or all possible combinations thereof. Further, it should be appreciated that the term 'and/or' used herein encompasses any and all possible combinations of one or more of the listed items. The terms such as "comprise(s)", "include(s)" "have/has", and "consist(s) of" used in the disclosure are only intended to designate that there are features, components, parts, or a combination thereof described in the disclosure, and are not intended to exclude a possibility of the presence or addition of one or more other features, components, parts, or a combination thereof, by using these terms. The terms such as "the first", "the second", or "first", or "second" may be used simply to distinguish a corresponding component from another corresponding component, and do not limit the corresponding components in view of other aspect (e.g., importance or order).

As used in the disclosure, the expression 'configured to ~' may be used interchangeably with, depending on the context, for example, 'suitable for ~', 'having the ability to ~', 'designed to ~', 'modified to ~', 'made to ~', 'capable of ~' or the like. The term 'configured to ~' may not necessarily mean only 'specially designed to ~' in hardware. Instead, in some situations, the expression 'a device configured to ~' may mean that the device is 'capable of ~' together with another device or component. For example, a phrase 'a device configured to perform A, B, and C' may imply a dedicated device for performing a corresponding operation or imply a general-purpose device capable of performing various operations including the corresponding operation.

Meanwhile, the terms 'upper', 'lower', and 'forward/backward direction' used in the disclosure are defined on the basis of the drawings, and the shapes and positions of each component are not limited by these terms.

Although the foregoing description in the disclosure has been made on the basis of specific embodiments, the disclosure is not limited to such specific embodiments, and it should be understood that it encompasses any and all various modifications, equivalents, and/or substitutes of various embodiments.

What is claimed is:

1. A robot cleaner, comprising:

a rotation motor;

a rotation member that is rotatable by driving of the rotation motor, and having a first surface, a second surface-opposite to the first surface, and an opening through the rotation member and penetrating the first surface and the second surface; and a floorcloth coupling member disposed on the second surface, and having a floorcloth attaching unit insertable into the opening to be detachably coupled to a floorcloth in contact with the first surface, wherein the floorcloth attaching unit is formed to protrude downward from a bottom surface of the floorcloth coupling member, and wherein the rotation member and the floorcloth coupling member are configured so that:

when the floorcloth attaching unit is inserted into the opening and detachably coupled to the floorcloth in contact with the first surface, and the rotation member rotates in a first direction, the floorcloth attaching unit remains coupled to the floorcloth, and when the floorcloth attaching unit is inserted into the opening and detachably coupled to the floorcloth in contact with the first surface, and the rotation member rotates in a second direction opposite to the first direction, the floorcloth attaching unit exits the opening so that the floorcloth becomes detached from the floorcloth attaching unit.

2. The robot cleaner according to claim 1, wherein the rotation member is configured to rotate in the second direction to detach the floorcloth from the floorcloth attaching unit in a second state;

wherein the rotation member includes a first inclined portion which extends ascending from an inner position of the opening toward the second surface along the second direction, at one side of the opening;

wherein the floorcloth attaching unit includes a second inclined portion disposed to face the first inclined portion above the first inclined portion when the floorcloth attaching unit is inserted into the opening; and wherein when the rotation member rotates in the second direction in the second state, the second inclined portion of the floorcloth attaching unit ascends along the first inclined portion of the rotation member to exit the opening.

3. The robot cleaner according to claim 1, wherein the rotation member is configured to rotate in the second direction to detach the floorcloth from the floorcloth attaching unit in a second state, and is configured to rotate in the first direction to clean a floor surface in a first state;

wherein the rotation member includes a first reverse inclined portion which extends descending from the second surface toward an outside of the opening along the first direction, at one side of the opening;

wherein the floorcloth attaching unit includes a second reverse inclined portion disposed to face the first reverse inclined portion under the first reverse inclined portion when the floorcloth attaching unit is inserted into the opening; and wherein when the rotation member rotates in the first direction in the first state, the first reverse inclined portion and the second reverse inclined portion are engaged with each other.

4. The robot cleaner according to claim 1, wherein the robot cleaner includes a stopper configured to limit rotation of the floorcloth coupling member, when coupled to the floorcloth coupling member; and wherein the floorcloth coupling member includes a stopper coupling capable of coupling with the stopper.

5. The robot cleaner according to claim 4, wherein a first state is a state that the stopper is released from the stopper coupling, and a second state is a state that the stopper is coupled to the stopper coupling to limit rotation of the floorcloth coupling member.

6. The robot cleaner according to claim 4, further comprising:

a lifting motor configured to move the rotation member in an axial direction, wherein a second state occurs as the lifting motor drives the rotation member to move toward the stopper to cause the stopper to be coupled to the stopper coupling.

7. The robot cleaner according to claim 4, further comprising:

a stopper moving unit configured to move the stopper toward the stopper coupling or away from the stopper coupling, wherein a second state occurs as the stopper moving unit drives the stopper to move toward the stopper coupling to be coupled to the stopper coupling.

8. The robot cleaner according to claim 4, wherein the stopper includes an insert capable of being inserted into the stopper coupling along a third direction from an upper side of the floorcloth coupling member; and wherein the insert is configured to have at least one inclined surface inclined with respect to the third direction.

9. The robot cleaner according to claim 4, wherein the stopper has an insert capable of being inserted into the stopper coupling along a third direction from an upper side of the floorcloth coupling member at one end of the insert; and wherein the stopper has an elastic member disposed at an other end of the insert.

10. The robot cleaner according to claim 1, wherein the rotation motor and the rotation member are connected via a rotation shaft member, and the rotation shaft member is disposed to penetrate the floorcloth coupling member.

11. A method of controlling a robot cleaner that includes rotation a motor; a rotation member that is rotatable by driving of the rotation motor, and having a first surface, a second surface opposite to the first surface, and an opening through the rotation member and penetrating the first surface and the second surface; a floorcloth coupling member disposed on the second surface, and having a floorcloth attaching unit insertable into the opening to be detachably coupled to a floorcloth in contact with the first surface, wherein the floorcloth attaching unit is formed to protrude downward from a bottom surface of the floorcloth coupling member a stopper that is coupleable to the floorcloth coupling member and configured to limit rotation of the floorcloth coupling member when coupled to the floorcloth coupling member, wherein the rotation member, the floorcloth coupling member, and the stopper are configured so that (a) when the floorcloth attaching unit is inserted into the opening and detachably coupled to the floorcloth in contact with the first surface, and the rotation member rotates in a first direction, the floorcloth attaching unit remains coupled to the floorcloth, and (b) when the floorcloth attaching unit is inserted into the opening and detachably coupled to the floorcloth in contact with the first surface, and the rotation member rotates in a second direction opposite to the first direction, the floorcloth attaching unit exits the opening so that the floorcloth becomes detached from the floorcloth attaching unit, the method comprising:

with the floorcloth attaching unit inserted into the opening and detachably coupled to the floorcloth in contact with the first surface, determining whether replacement of the floorcloth is required;

based on determining that the replacement of the floorcloth is required, coupling the stopper to the floorcloth coupling member; and with the floorcloth attaching unit inserted into the opening and detachably coupled to the floorcloth in contact with the first surface and the stopper coupled to the floorcloth coupling member, rotating the rotation member in the second direction so that the floorcloth attaching unit exits the opening and the floorcloth becomes detached from the floorcloth attaching unit.

12. The method according to claim 11, wherein the floorcloth coupling member includes a stopper coupling capable of coupling with the stopper, and wherein a first state is a state that the stopper is released from the stopper coupling, and a second state is a state that the stopper is coupled to the stopper coupling to limit rotation of the floorcloth coupling member.

13. The method according to claim 11, wherein the robot cleaner further includes a lifting motor configured to move the rotation member along an axial direction, and wherein the floorcloth coupling member includes a stopper coupling capable of coupling with the stopper, and wherein the coupling the stopper to the floorcloth coupling member includes moving the rotation member toward the stopper by driving the lifting motor.

14. The method according to claim 13, wherein a second state occurs as the lifting motor drives the rotation member to move toward the stopper to cause the stopper to be coupled to the stopper coupling.

15. The method according to claim 11, wherein the robot cleaner further includes a stopper moving unit configured to move the stopper toward the floorcloth coupling member or away from the floorcloth coupling member, and wherein the floorcloth coupling member includes a stopper coupling capable of coupling with the stopper, and wherein the coupling the stopper to the floorcloth coupling member includes moving, by the stopper moving unit, the stopper to move toward the stopper coupling to be coupled to the stopper coupling.

16. The method according to claim 15, wherein a second state occurs as the stopper moving unit drives the stopper to move toward the stopper coupling to be coupled to the stopper coupling.

17. The method according to claim 11, further comprising:

after performing the rotating the rotation member in the second direction, determining whether a fresh floor cloth is required to be attached to the floorcloth attaching unit;

based on determining that a fresh floorcloth is required to be attached to the floorcloth attaching unit, rotating the rotation member in the first direction; and uncoupling the stopper from the floorcloth coupling member.

18. The method according to claim 11, further comprising:

determining whether to perform a floor cleaning; and based on determining that the floor cleaning is to be performed, rotating the rotation member in the first direction in which the stopper is uncoupled from the floorcloth coupling member and the floorcloth attaching unit is inserted into the opening and detachably coupled to the floorcloth in contact with the first surface.

19. The method according to claim 11, wherein the stopper includes an insert capable of being inserted into the stopper coupling along a third direction from an upper side of the floorcloth coupling member; and wherein the insert is configured to have at least one inclined surface inclined with respect to the third direction.

20. The method according to claim 11, wherein the stopper has an insert capable of being inserted into the stopper coupling along a third direction from an upper side of the floorcloth coupling member at one end of the insert; and wherein the stopper has an elastic member disposed at an other end of the insert.

* * * * *